US008033338B2

(12) United States Patent
Springett

(10) Patent No.: US 8,033,338 B2
(45) Date of Patent: Oct. 11, 2011

(54) WELLBORE CONTINUOUS CIRCULATION SYSTEMS AND METHOD

(75) Inventor: Frank Benjamin Springett, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 385 days.

(21) Appl. No.: 12/319,547

(22) Filed: Jan. 8, 2009

(65) Prior Publication Data

US 2009/0205838 A1 Aug. 20, 2009

Related U.S. Application Data

(60) Provisional application No. 61/011,849, filed on Jan. 22, 2008.

(51) Int. Cl.
*E21B 21/10* (2006.01)

(52) U.S. Cl. ..... 166/386; 166/77.51; 166/81.1; 166/95.1; 166/90.1; 175/218

(58) Field of Classification Search ..... 166/380, 166/386, 77.51, 80.1, 90.1, 95.1, 81.1; 175/218, 175/162

See application file for complete search history.

(56) References Cited

U.S. PATENT DOCUMENTS

| | | | | |
|---|---|---|---|---|
| 1,491,986 | A | 4/1924 | Greene | |
| 2,102,555 | A | 12/1937 | Dyer | |
| 2,158,356 | A | 5/1939 | Dyer | |
| 2,522,444 | A | 9/1950 | Grable | 166/16 |
| 3,078,921 | A * | 2/1963 | Edwards | 166/97.1 |
| 3,298,385 | A | 1/1967 | Jackson et al. | |
| 4,310,050 | A | 1/1982 | Bourgoyne, Jr. | 166/318 |
| 4,448,267 | A | 5/1984 | Crawford et al. | 175/218 |
| 4,646,844 | A | 3/1987 | Roche et al. | 166/379 |
| 5,332,044 | A | 7/1994 | Dallas et al. | 166/386 |
| 5,584,343 | A | 12/1996 | Coone | 166/387 |
| 6,253,861 | B1 | 7/2001 | Carmichael et al. | 175/237 |
| 6,315,051 | B1 | 11/2001 | Ayling | 166/380 |
| 6,412,554 | B1 | 7/2002 | Allen et al. | 166/80.1 |

(Continued)

FOREIGN PATENT DOCUMENTS

WO WO01/69034 9/2001

(Continued)

OTHER PUBLICATIONS

PCT/GB2009/050047 International Search Report (Dec. 8, 2010).

(Continued)

*Primary Examiner* — David Andrews
(74) *Attorney, Agent, or Firm* — The JL Salazar Law Firm, pllc

(57) ABSTRACT

Systems and methods for continuously circulating fluid, e.g., drilling mud, through a wellbore tubular string, the systems in certain aspects including a sub positionable in fluid communication with the tubular string, the sub with a body, a plug releasably closing off a side opening of the body, and a closure apparatus for selectively closing off flow from the top of the sub into and through the body, while flow is permitted below the closure apparatus through the side opening down through the body into the tubular string; and, in certain aspects, such systems and methods including tubular manipulation apparatus, e.g. an iron roughneck and working with wellbore tubulars with the tubular manipulation apparatus.

30 Claims, 17 Drawing Sheets

U.S. PATENT DOCUMENTS

| | | | | |
|---|---|---|---|---|
| 6,581,692 | B1 | 6/2003 | Koch et al. | 166/380 |
| 6,591,916 | B1 | 7/2003 | Ayling | 166/380 |
| 6,688,394 | B1 | 2/2004 | Ayling | 166/380 |
| 6,739,397 | B2 | 5/2004 | Ayling | 166/380 |
| 6,938,709 | B2 | 9/2005 | Juhasz et al. | 175/52 |
| 7,028,787 | B2 | 4/2006 | Allen et al. | 175/162 |
| 7,107,875 | B2 | 9/2006 | Haugen et al. | 81/57.15 |
| 7,134,489 | B2 | 11/2006 | VanRiet | 166/207 |
| 7,188,683 | B2 | 3/2007 | Ayling | 175/57 |
| 7,252,151 | B2 | 8/2007 | Ayling | 166/380 |
| 7,281,582 | B2 | 10/2007 | Robichaux et al. | 166/291 |
| 7,322,418 | B2 | 1/2008 | Ayling | 166/380 |
| 7,350,587 | B2 | 4/2008 | Springett et al. | 166/380 |
| 7,413,008 | B2 | 8/2008 | Basso | 166/90.1 |
| 7,510,006 | B2 | 3/2009 | Juhasz et al. | 166/291 |
| 2006/0254822 | A1 | 11/2006 | Ayling | 175/57 |
| 2006/0278434 | A1 | 12/2006 | Calderoni et al. | 175/57 |
| 2009/0025930 | A1 * | 1/2009 | Iblings et al. | 166/244.1 |

FOREIGN PATENT DOCUMENTS

| | | |
|---|---|---|
| WO | WO2005/019596 | 3/2005 |
| WO | WO2005/080745 | 9/2005 |
| WO | WO2006/059146 | 6/2006 |
| WO | WO2009/018173 | 2/2009 |
| WO | WO2009/022914 | 2/2009 |

OTHER PUBLICATIONS

Continuous Circulation System CCS. Maintains constant down-hole pressure during connections. Shaffer—A Varco Company. 2 pp. 2003.

Winning the circulation war, vonFlatern, Offshore Engineer, 6 pp. Nov. 1, 2003.

PCT/GB 2009/050047 Partial International Search Report (Jul. 14, 2010).

* cited by examiner

WELLBORE CONTINUOUS CIRCULATION SYSTEMS AND METHOD

CROSS-REFERENCE TO RELATED INVENTION

The present invention and application claim the benefits of priority, under the Patent Laws, of U.S. Application Ser. No. 61/011,849 filed Jan. 22, 2008.

BACKGROUND OF THE INVENTION

1. Field of the Invention

This invention is directed to wellbore operations with strings of tubulars and, in certain particular aspects, to tubular subs and related systems useful for maintaining continuous circulation during joint make-up and break-out.

2. Description of Related Art

There are a variety of known continuous circulation systems; for example, and not by way of limitation, the following U.S. Patents and application present exemplary systems and components thereof: U.S. Pat. Nos. 7,350,587; 7,107,875; 6,412,554; 6,315,051; 6,591,916; 3,298,385; 1,491,986; and U.S. application Ser. No. 11/449,662 filed Jun. 9, 2006.

These are a variety of known wellbore, subs, continuous circulation systems, and related components, including, for example, the disclosures of U.S. Pat. Nos. 2,102,555; 2,158,356; 4,310,050; 4,448,267; 4,646,844; 6,253,861; 6,688,394; 6,739,397; 7,028,787; 7,134,489; and 7,281,582; and U.S. Applications Publication Nos. 2002/0157838 published Oct. 31, 2002; and 2006/0254822 published Nov. 16, 2006—all said patents and said applications incorporated fully herein for all purposes.

In the drilling industry, e.g. in the field of drilling for oil, natural gas and other hydrocarbons, drill strings are used that include a large number of tubular sections, referred to as "tubulars", which are connected by male threads on the pin ends and female threads on the box ends. In many operations such tubulars are added to the drill string, one-by-one, or in "stands" of two or three connected tubulars, as the string carrying a drill bit drills into the ground. Often it is necessary to withdraw the drill string, in whole or in part. Again, each tubular or stand is unscrewed, one-by-one, as the drill string is brought up to the extent required.

With some prior systems, each time that a tubular is added or removed, the drilling process is stopped and the circulation of drilling fluid ceases. Resulting delays in the overall drilling operation are expensive. The circulation of drilling fluids can be extremely critical to maintaining a steady down hole pressure and a steady and near constant equivalent circulating density. Often when tripping a drill string into or out of a well, the lack of continuous circulation of a drilling fluid can cause pressure changes in the well which increase the probability of undesirable "kicks". The connection of sections of casing in a wellbore present similar problems with circulating fluids.

Various prior systems have a variety of disadvantages and problems associated with their use; for example, in some prior systems valves internal to a sub are sent down a well where they are susceptible to wear and failure. Many items (e.g. fishing tool, logging equipment, downhole tools, etc.) to be located in a wellbore beneath a sub are limited in diameter to a diameter which will pass through the sub. In certain aspects, a valve seat portion of a sub will have a relatively small diameter which limits the size of items which can be inserted through the sub.

"Iron roughnecks," combine a torque wrench and a spinning wrench to connect and disconnect tubulars, e.g. drilling components, e.g. drill pipe, in running a string of tubulars into or out of a well. Prior art iron roughnecks are shown. e.g., in U.S. Pat. Nos. 4,023,449; 4,348,920; 4,765,401; 6,776,070; 7,062,991; 7,188,547; and 7,313,986, all of which are incorporated herein by reference in their entirety. Certain prior art iron roughnecks have a spinning wrench and a torque wrench mounted together on a carriage. For making or breaking threaded connections between two tubulars, e.g. joints of drill pipe, certain iron roughnecks have a torque wrench with two jaw levels. An upper jaw of the torque wrench is used to clamp onto a portion of an upper tubular, and a lower jaw clamps onto a portion of a lower tubular, e.g. upper and lower threadedly connected pieces of drill pipe. After clamping onto a tubular, the upper and lower jaws are turned relative to each other to break or make a connection between the upper and lower tubulars. A spinning wrench, mounted on the carriage above the torque wrench, engages the upper tubular and spins it until it is disconnected from the lower tubular (or in a connection operation, spins two tubulars together prior to final make-up by the torque wrench).

Certain iron roughnecks are mounted for movement from a wellbore center to a retracted position which does not interfere with or block performance of other operations relative to the well and rotating or driving apparatuses. Such a prior art system can be used for making and breaking joints in a main string or for connecting to or disconnecting from a tubular section located apart from a wellbore center, e.g. in a mousehole (or rathole) at a side of a well.

Certain prior art iron roughneck systems include a carriage for rolling on the surface of the rig floor along a predetermined path. In certain prior art systems a spinner and torque wrench are mounted for upward and downward movement relative to a carriage, for proper engagement with tubulars, and for tilting movement between a position in which their axis extends directly vertically for engagement with a vertical well pipe and a position in which the axis of the spinner and torque wrench is disposed at a slight angle to true vertical to engage and act against a pipe in an inclined mousehole. In certain prior art systems, a spinner is movable vertically with respect to a torque wrench.

There are a variety of known torque wrenches and tongs for use in wellbore operations, e.g., but not limited to, as disclosed in and referred to in U.S. Pat. Nos. 3,892,140; 4,221,269; 4,425,827; 4,446,761; 6,684,737; 6,971,283; 5,161,438; 5,159,860; 5,842,390; 5,245,877; 5,259,275; 5,390,568; 4,346,629; 5,044,232; 5,081,888; 5,167,173; 5,207,128; 5,409,280; 5,868,045; 6,966,385; 6,138,529; 4,082,017; 6,082,224; 6,213,216; 6,330,911; 6,668,684; 6,752,044; 6,318,214; and 6,142,041; 6,253,845; and 7,000,502.

BRIEF SUMMARY OF THE INVENTION

The present invention, in various aspects, discloses a system that includes tubular manipulation apparatus (e.g. tong or tongs, tong and back-up, tong and spinner, or iron roughneck) and a continuous circulation apparatus. In certain such systems, a continuous circulation apparatus is mounted below an iron roughneck, and is extendable therewith toward a tubular manipulation apparatus, e.g. toward and away from a tubular or tubular string and/or toward and away from a well center.

The present invention, in certain aspects, discloses a sub system for use in continuous circulation wellbore operations, the sub system having a sub positionable in fluid communication with a wellbore tubular string, the sub having a body, the body being generally cylindrical and having a first end, a second end, and an exterior surface, the second end connectible to a wellbore tubular string, a bore through the body from the first end to the second end, the bore having an inner boundary defined by an inner surface of the body, the bore positionable for fluid communication with the wellbore tubular string, a side opening in the body, the side opening extending from the exterior surface of the body to the inner surface, and the sub system having closure apparatus including a housing in fluid communication with the side opening of the body of the sub, the closure apparatus including a closure mechanism outside the body, the closure mechanism including a closure member within the housing and selectively insertable into the side opening and removable from the bore of the body, the closure member movable to selectively close off flow from the first end of the body.

In one aspect, such a system has a plug removably and sealingly secured in the side opening, the plug having a plug body, and the system including a securement mechanism connected to the plug body for releasably securing the plug in the side opening.

In one aspect, the present invention discloses such a system with plug movement apparatus to which the plug is connected for moving the plug out of the side opening and away from the side opening.

In another aspect, in such a system a plug movement apparatus includes stinger apparatus movable to connect with the plug and operate the securement mechanism to release the plug from the side opening.

In one aspect, in such a system the housing of the closure apparatus has an interior space and fluid is flowable through the interior space of the housing into the bore of the body of the sub through an upper end and out through a lower end of the bore of the body so that continuous fluid circulation can be maintained in a wellbore tubular string.

The present invention discloses, in certain aspects, systems for continuous circulation wellbore operations, the systems including a sub system having a sub positionable in fluid communication with a wellbore tubular string, the sub having: a body, the body being generally cylindrical and having a first end, a second end, and an exterior surface, the second end connectible to a wellbore tubular string; a bore through the body from the first end to the second end, the bore having an inner boundary defined by an inner surface of the body, the bore positionable for fluid communication with the wellbore tubular string; a side opening in the body, the side opening extending from the exterior surface of the body to the inner surface; and the sub system further including closure apparatus including a housing in fluid communication with the side opening of the body of the sub, the closure apparatus including a closure mechanism outside the body, the closure mechanism including a closure member within the housing and selectively insertable into the side opening and removable from the bore of the body, the closure member movable to selectively close off flow from the first end of the body. In certain embodiments, these systems include tubular manipulation apparatus adjacent the sub system, movable therewith, selectively movable therewith, or independently thereof, with the tubular manipulation apparatus being one of tong, tongs, tong and back-up, tong and spinning wrench, and iron roughneck.

The present invention discloses, in certain aspects, a system for continuous circulation wellbore operations, the system having: a sub system positionable in fluid communication with a wellbore tubular string; the sub system for selectively closing off flow to the wellbore tubular string; and tubular manipulation apparatus adjacent the sub. In certain aspects, the tubular manipulation apparatus is one of tong, tongs, tong and back-up, tong and spinning wrench, and iron roughneck.

Accordingly, the present invention includes features and advantages which are believed to enable it to advance continuous circulation technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious continuous circulation systems and methods of their use; and, in certain aspects, new, useful, nonobvious and efficient systems for wellbore operations, with a sub that permits continuous circulation of drilling fluid, the system providing selective opening of a sub side opening and selective prevention of fluid flow from the top of the sub to and through the sub, while fluid is flowable from the side of the sub down into a tubular string below the sub; and any such system and method used with tubular manipulation apparatus, e.g. but not limited to, a tong, tongs, a tong and back-up, a tong and a spinner, or an iron roughneck.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings with FIG. 1A is a perspective view of a continuous circulation sub according to the present invention and a continuous circulation system according to the present invention.

Figure 1A:
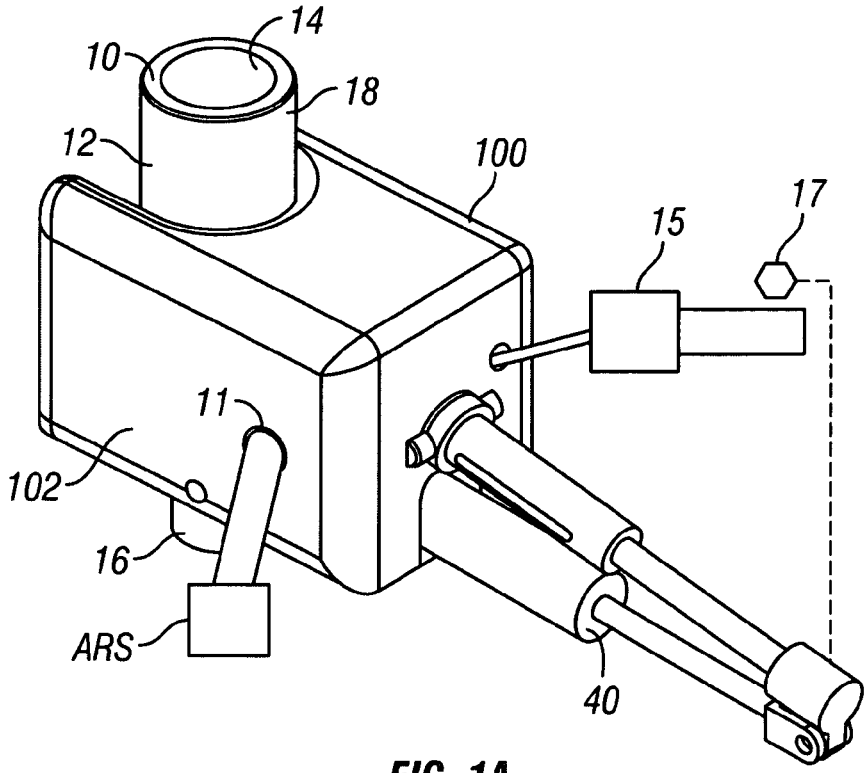
FIG. 1B is a side cross-section view of a continuous circulation sub and a continuous circulation system of FIG. 1A.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 1B:
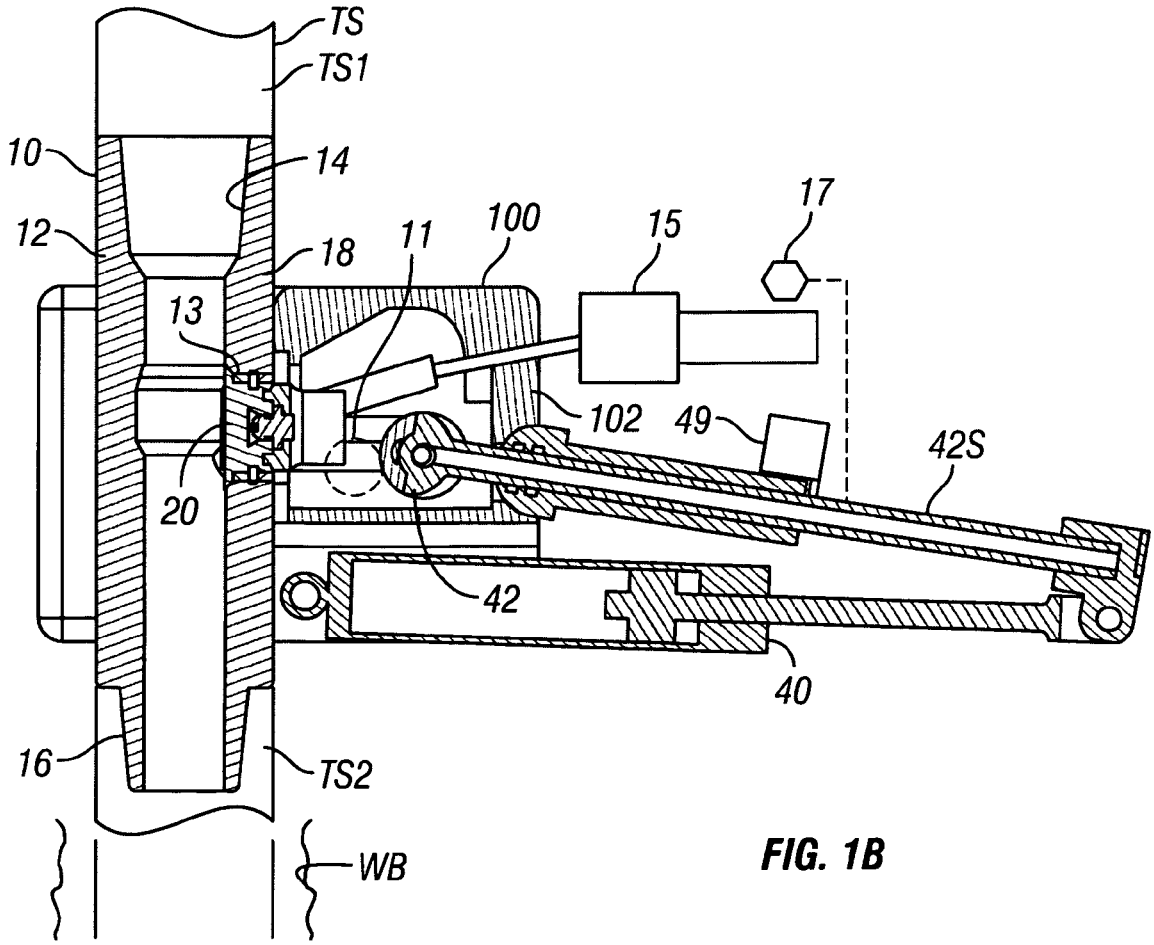

FIGS. 1A and 1B show a continuous circulation sub 10 according to the present invention and a continuous circulation system 100 according to the present invention. The continuous circulation sub 10 has a body 12 with a flow bore 14 from top to bottom, a threaded pin end 16, and a threaded box end 18. The continuous circulation sub 10 is in a tubular string TS (parts TS1 and TS2 shown schematically, FIG. 1B; e.g. a string from a rig or platform extending down into the earth). The continuous circulation system 100 has a housing 102.

Figure 2B:
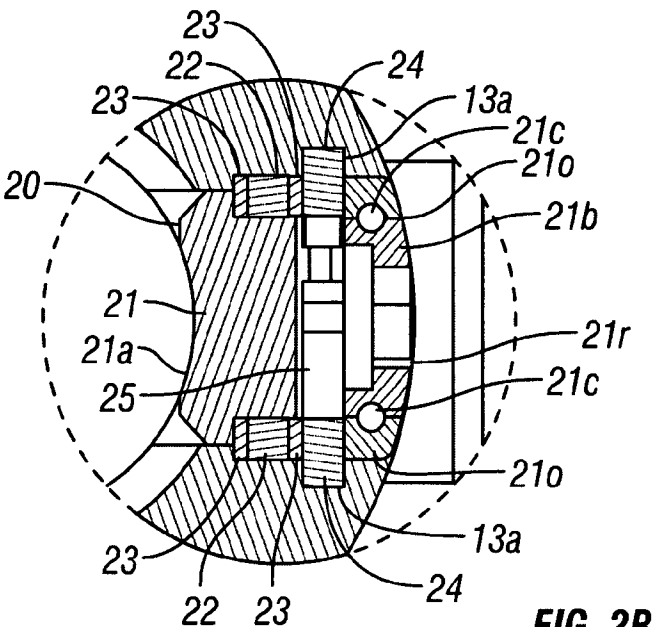
FIG. 2B is an enlargement of part of the sub and system as shown in FIG. 2A.
Figure 3A:
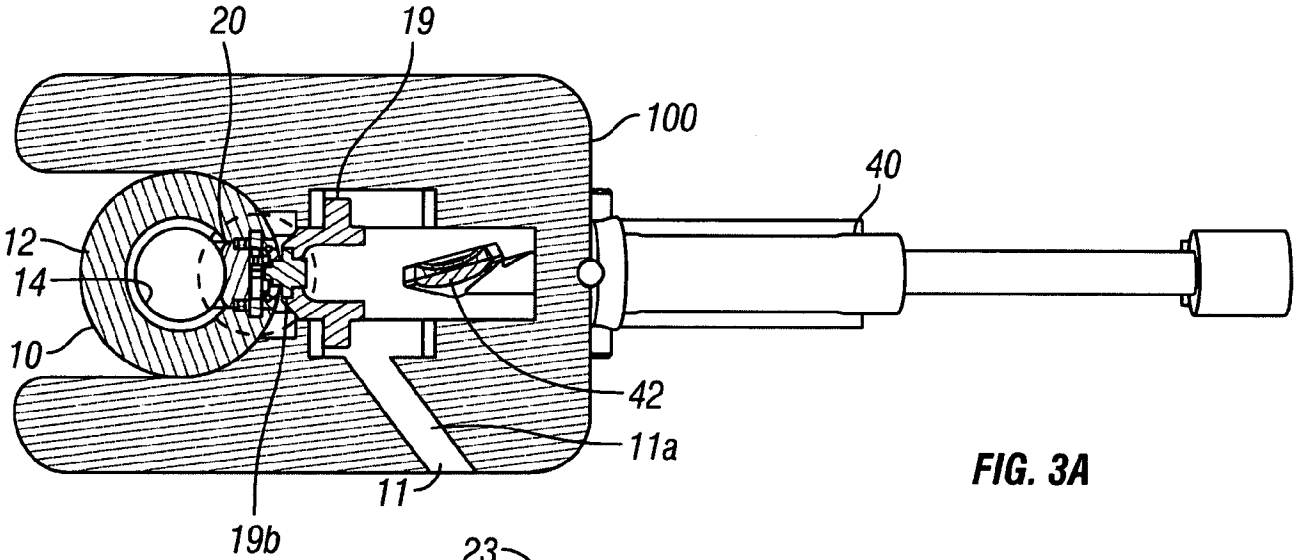
FIG. 3A is a top cross-section view of the continuous circulation sub and a continuous circulation system of FIG. 1A.
Figure 3B:
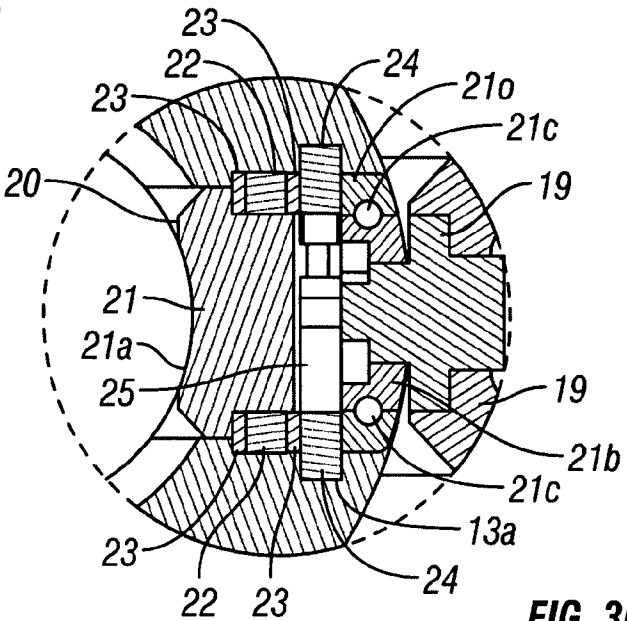
FIG. 3B is an enlargement of part of the sub and system as shown in FIG. 3A.
Figure 3C:
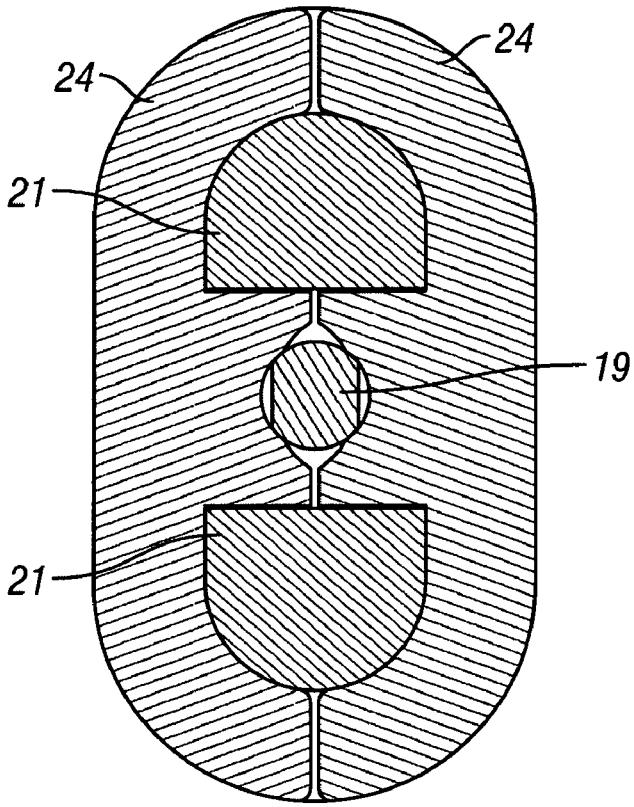
FIG. 3C is a cross-section view of part of the sub of FIG. 1A.
Figure 3D:
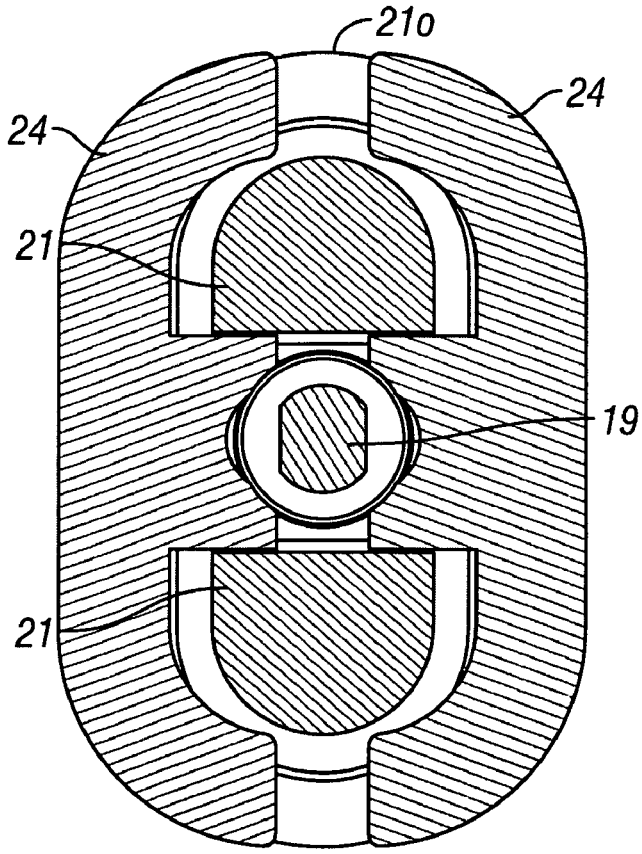
FIG. 3D is a cross-section view of part of the sub of FIG. 1A.

A plug apparatus 20 is removably secured in an opening 13 of the body 12. When secured in place, the plug apparatus 20 prevents fluid flow through the opening 13 (e.g. see FIGS. 1B, 2B, 3B). A plug movement device 15 (shown schematically, FIGS. 1A, 1B) selectively activates and moves the plug apparatus 20. A control system 17 controls the plug apparatus 20 and a closure apparatus 40 (described below). The control system 17, in certain aspects, is directed to the type of controls used for the system; for example, and not by way of limitation, a control system can include: controls for a manual hydraulic valve system that operates the plug apparatus 20 and the closure apparatus 40; an electro-hydraulic control system; and a mechanical control system. In certain aspects the control system can employ linear motion devices (hydraulic, pneumatic, electric) which manipulate a closure apparatus and plug apparatus and other system components. The devices can be functional manually and/or via a computer system. Any such control system can have one or more computers, PLC's, and/or single board computers.

Figure 2A:
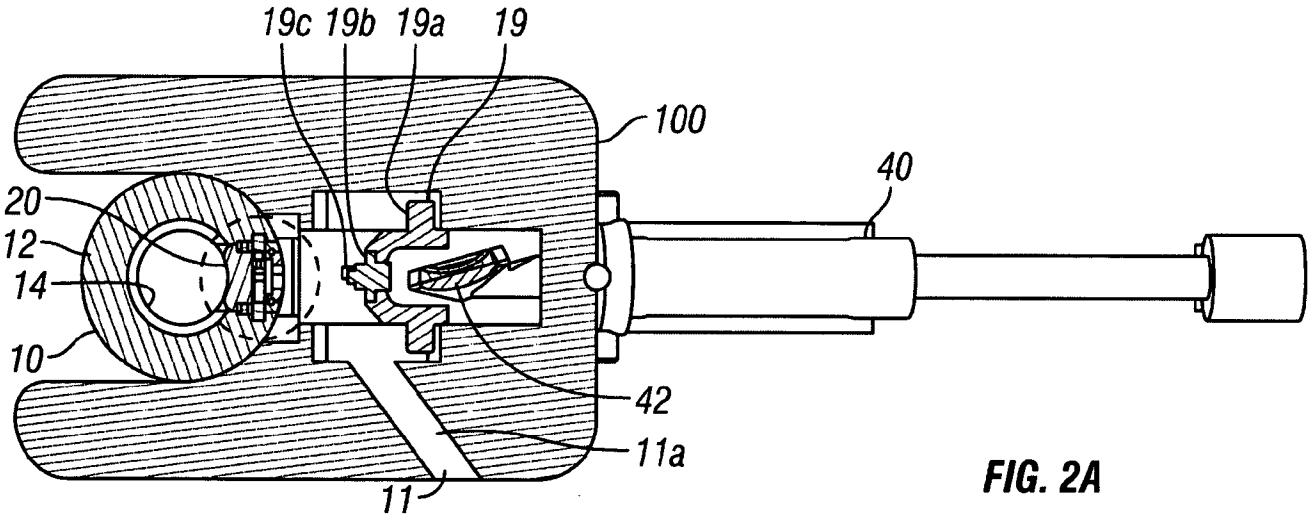
FIG. 2A is a top cross-section view of the continuous circulation sub and a continuous circulation system of FIG. 1A.

As shown in FIGS. 1B and 2A, the plug movement device 15 moves a stinger structure 19 toward and away from the plug apparatus 20. The stinger structure 19 has a body 19*a* and a stinger 19*b* with a tip 19*c*.

The plug apparatus 20 has a plug 21 with a concave body portion 21*a* which has no part which projects into the bore 14 (it can be recessed from the inner bore surface of flush with it). Seals 22 (made, e.g., of rubber or of any suitable seal material) seal an opening-13/plug-apparatus-20 interface. An anti-extrusion steel device 23 is on each side of the seals and helps to maintain the seals in place when pressure is applied to them. Fluid pressure pushing on the plug 21 pushes on the steel devices 23 which in turn push on the seals 22 to enhance sealing at the opening/apparatus interface. In one aspect, the outer surface of the plug is flush with the inner surface of the bore (i.e., the curvature of the outer surface of the plug matches the curvature of inner surface of the bore).

Two spaced-apart locking dogs 24 are movable into and out of corresponding side opening recesses 13*a*. With the dogs 24 within the recesses 13*a*, the plug apparatus 20 is secured in place. Retracting the dogs 24 from the recesses 13*a* with a dog movement device 25 releases the plug apparatus 20 so it can be removed from the opening 13 (as in FIGS. 4A, 4B, 5).

The plug 21 has an outer part 21*o* and a bore piece 21*b* with a bore 21*r* through which the stinger 19*b* can pass. Lock pins 21*c* hold the parts of the plug together.

The closure apparatus 40 has a closure structure 42 described in detail below.

Figure 4A:
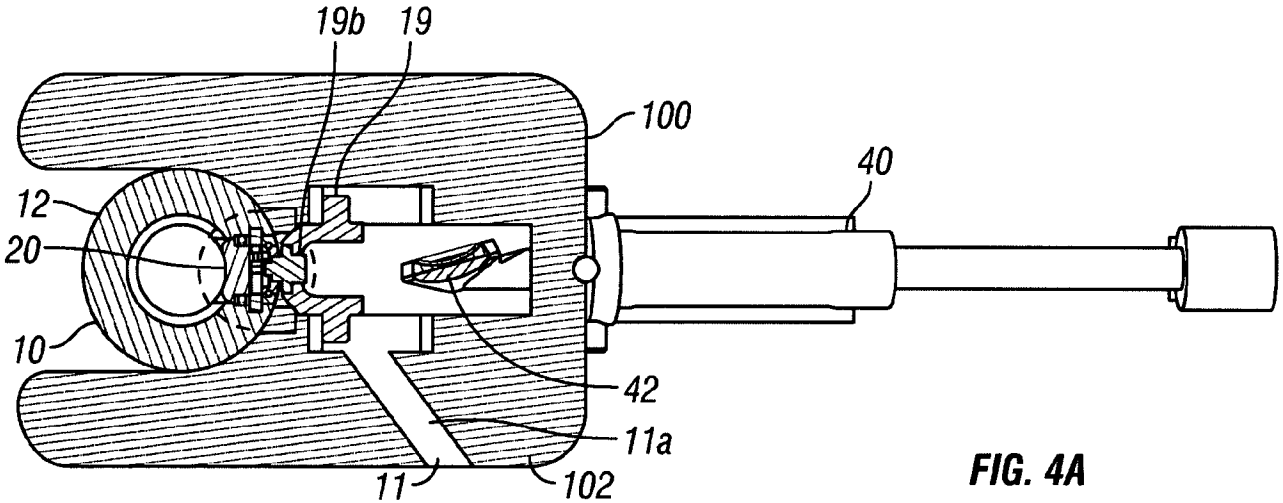
FIG. 4A is a top cross-section view of the continuous circulation sub and a continuous circulation system of FIG. 1A.
Figure 4B:
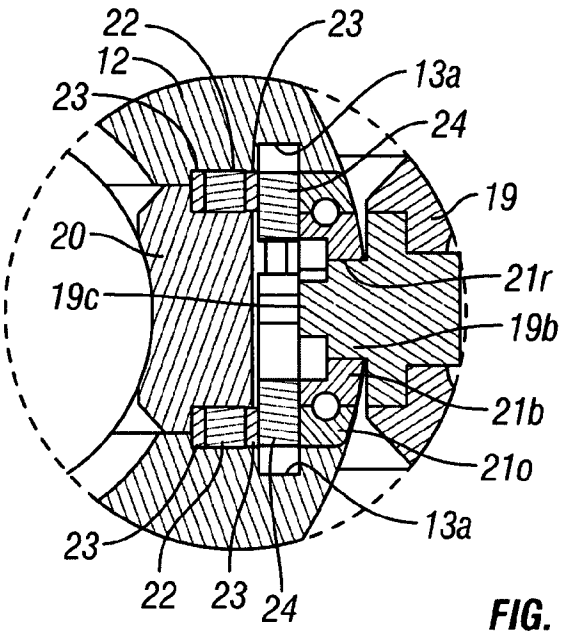
FIG. 4B is an enlargement of part of the sub and system as shown in FIG. 4A.

As shown in FIGS. 4A and 4B, the stinger structure 19 has moved so that the stinger 19*b* with tip 19*c* has activated the dog movement device 25, retracting the dogs 24 from the recesses 13*a*. The stinger structure 19 is movable with respect to the plug apparatus 20. With the plug apparatus 20 freed from the body 12 of the continuous circulation sub 10, the plug movement device 15 can remove the plug apparatus 20 from the opening 13 as shown in FIG. 5.

Figure 5:
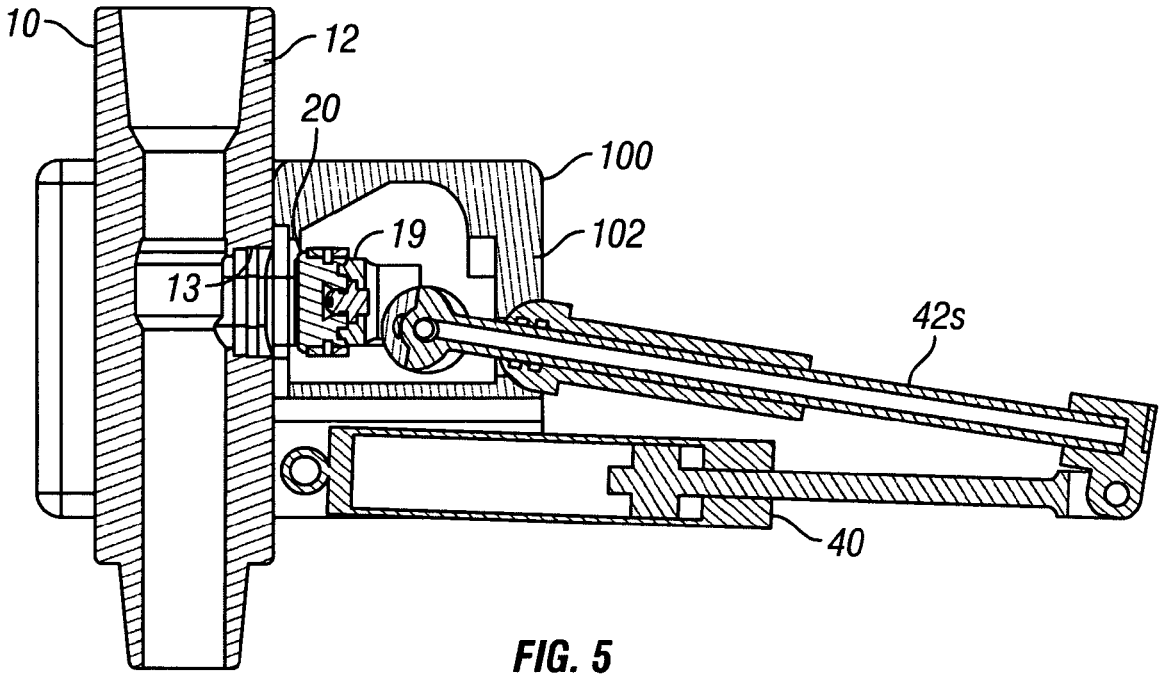
FIG. 5 is a side cross-section view of a continuous circulation sub and a continuous circulation system of FIG. 1A.
Figure 6:
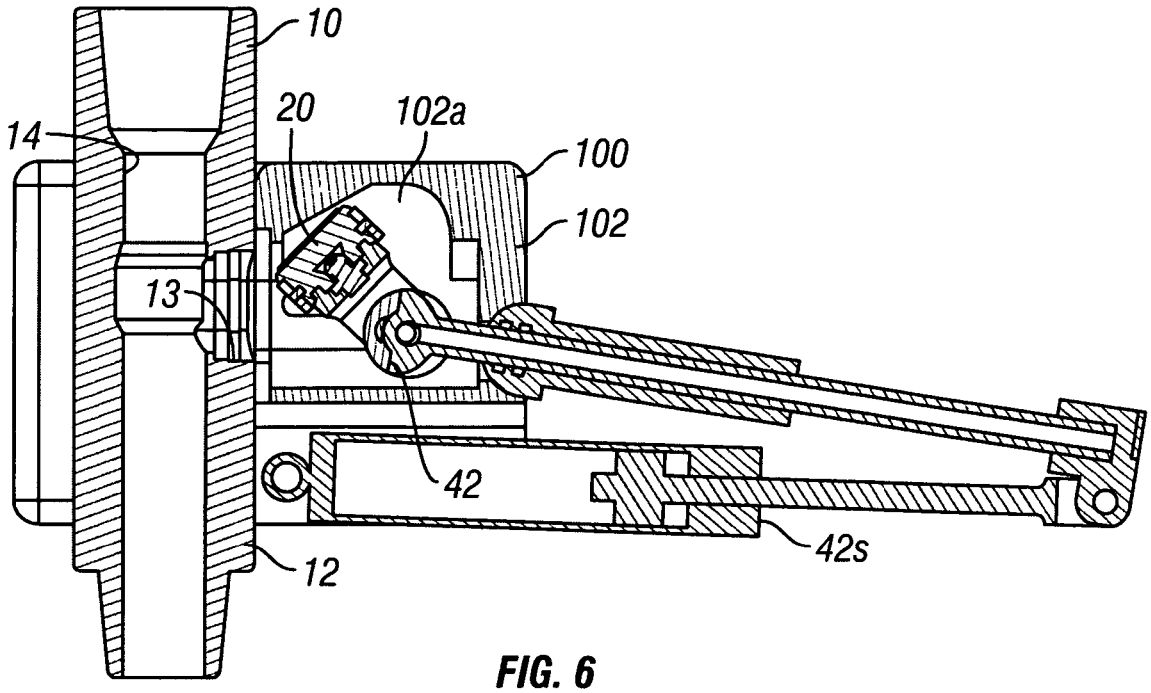
FIG. 6 is a side cross-section view of a continuous circulation sub and a continuous circulation system of FIG. 1A.
Figure 7:
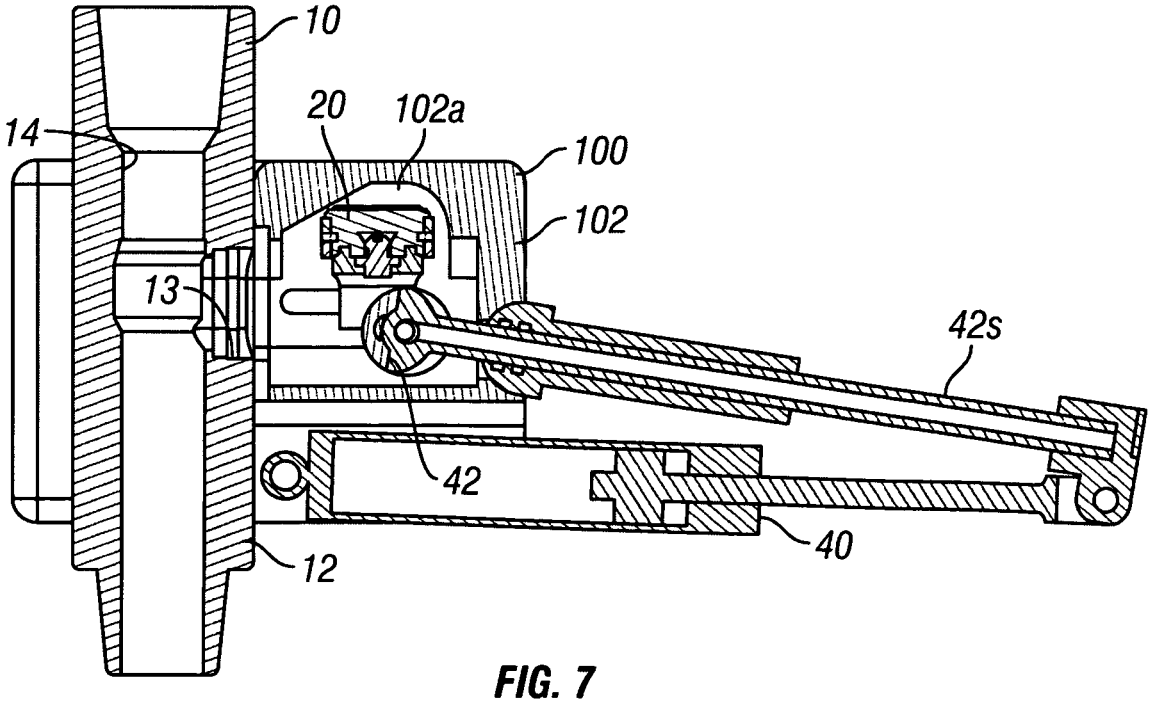
FIG. 7 is a side cross-section view of a continuous circulation sub and a continuous circulation system of FIG. 1A.

As shown in FIG. 6 the plug apparatus 20 is rotated away from the opening 13 by the plug movement device 15 and as shown in FIG. 7 the plug apparatus 20 has been rotated out of the way of the opening 13, e.g. about ninety degrees from its position in FIG. 5, and has been retracted so that a portion thereof is in a chamber 102*a* of the housing 102 of the continuous circulation system 100. Upon removal of the plug apparatus 20 from the opening 13 (e.g. see FIG. 5), fluid is flowable through the opening 13 into the bore 14 of the body 12 of the continuous circulation sub 10.

Figure 8:
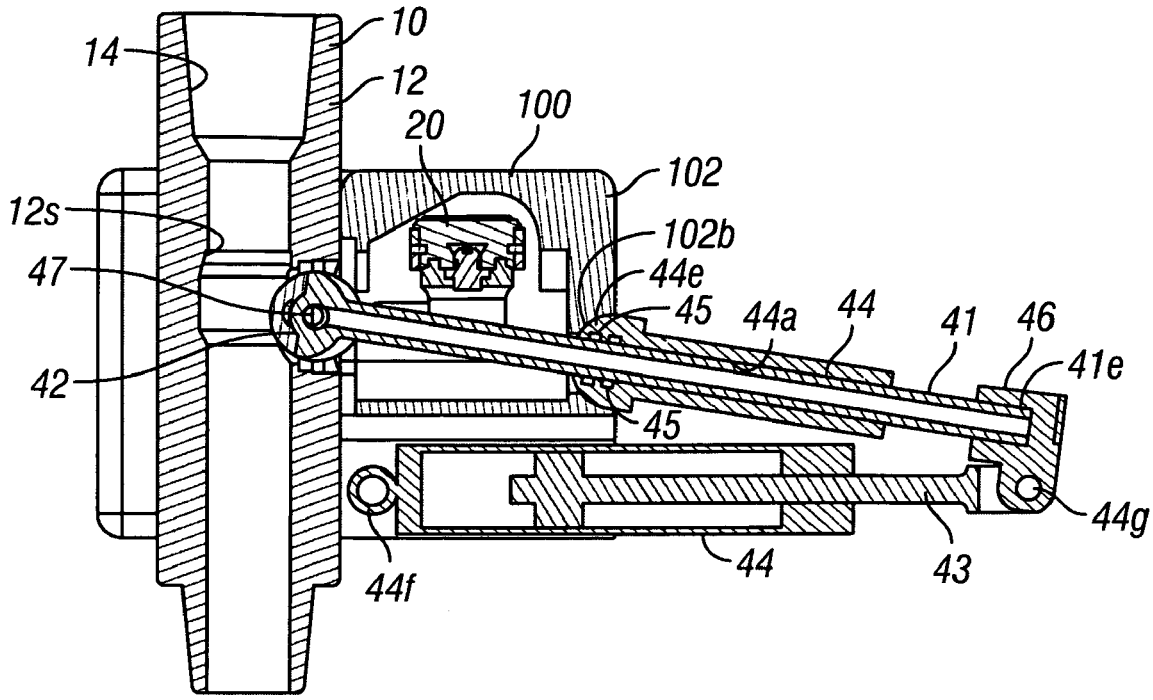
FIG. 8 is a side cross-section view of a continuous circulation sub and a continuous circulation system of FIG. 1A.

The opening 13 provides access to the bore 14 so that the closure structure 42 can be moved into position to close off flow through the bore 14. As shown in FIG. 8, the closure apparatus 40 has been activated and has moved a shaft 41 (an extendable shaft, e.g., a telescoping shaft or other extendable shaft) toward the opening 13 so that the closure structure 42 is passing through the opening 13. A piston 43 of a piston/cylinder assembly 44 is retracted to effect this movement of the shaft 41. The shaft 41 moves in a bore 44*a* of a body 44. The bore 44*a* is in communication with the interior of the housing 102. The shaft-41/body-44 interface is sealed with seals 45 and an end 44*e* of the body 44 is sealing secured in an opening 102*b* of the housing 102. An end 41*e* of the shaft 41 is secured to a pivot member 46 which is pivotably connected to an end 44*g* of the piston/cylinder assembly 44. Another end 44*f* of the piston/cylinder assembly 44 is pivotably connected to the housing 102. The closure structure 42 is rotatably mounted to the shaft 41 with a pin 47. A rotation mechanism 49, shown schematically in FIG. 1B, rotates the closure apparatus 42 by rotating a shaft 42*s* of the closure apparatus 42.

Figure 9:
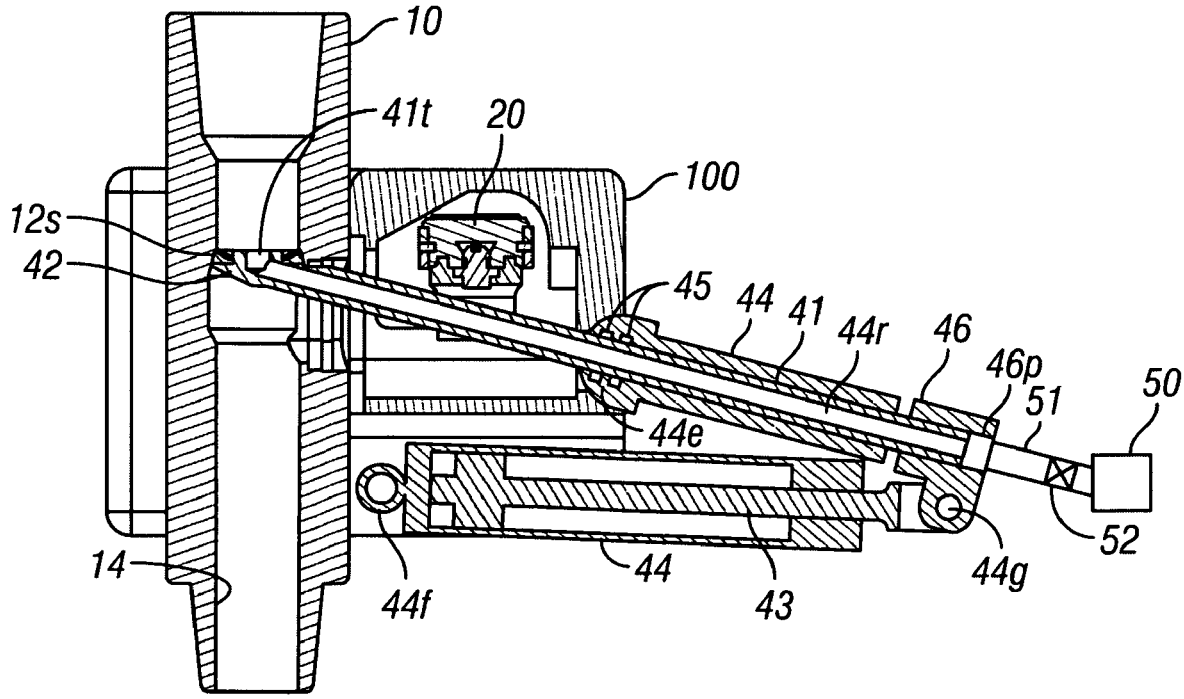
FIG. 9 is a side cross-section view of a continuous circulation sub and a continuous circulation system of FIG. 1A.

As shown in FIG. 9, the closure apparatus 42 has been rotated to seat against a shoulder 12*s* of the body 12 of the continuous circulation sub 10.

It is within the scope of the present invention for the shaft 41 (and its parts or pieces) to be solid so that no fluid flow through the shaft 41 is possible. Optionally, the shaft 41 has a bore 41*r* therethrough from one end to the other; with a top end opening 41*t* and, via a port 46*p* in the pivot member 46 and a line 51, is in fluid communication with a reservoir system 50 or rig mud system (e.g., like the system ARS, FIG. 1A). Valve apparatus 52 selectively controls flow in the line 51. Any suitable control system, including, but not limited to the control system 17, can control the valve apparatus 52. Any fluid, e.g. drilling fluid, that enters the top of the continuous circulation sub 10 is vented to the reservoir 50.

Figure 10:
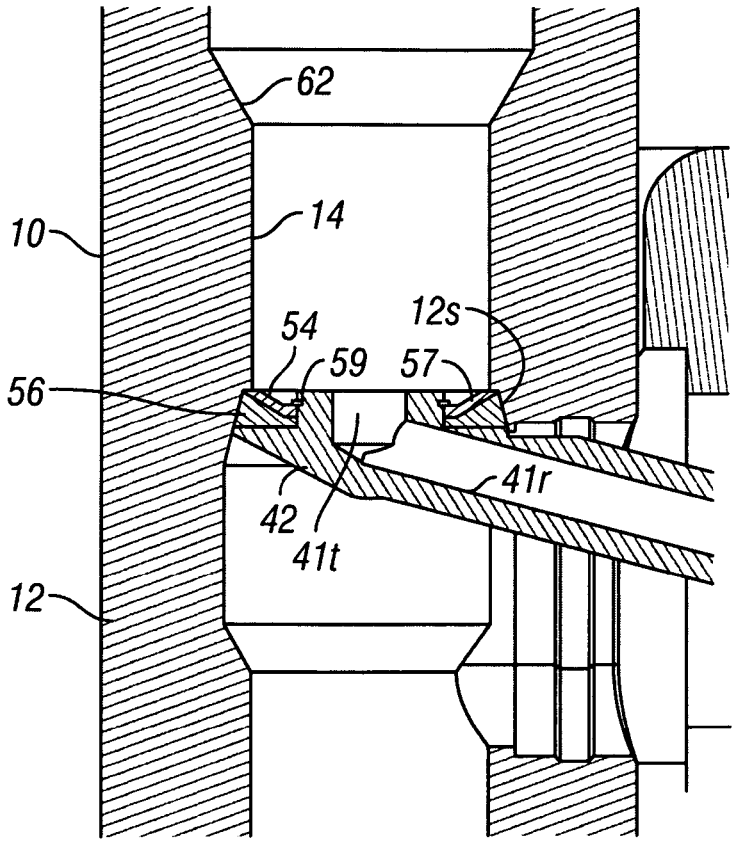
FIG. 10 is an enlargement of part of the sub and system as shown in FIG. 9.
Figure 10A:
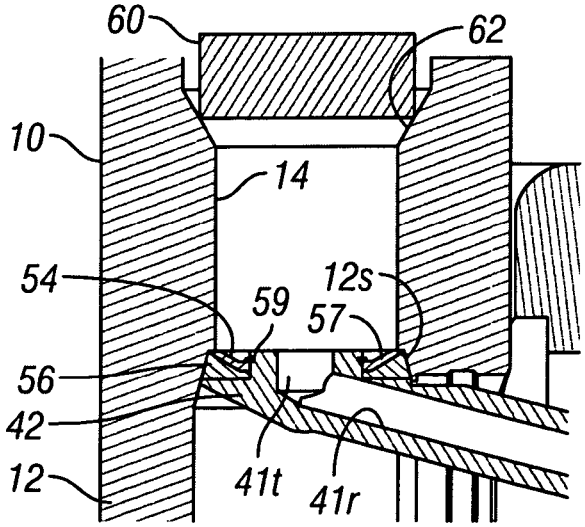
FIG. 10A is a cross-section view of the part shown in FIG. 10 with a seated closure member.

Any suitable seal or seal structure may be used to seal the closure apparatus 42 against the shoulder 12*s* of the body 12 of the continuous circulation sub 10. Optionally, as shown in FIGS. 9 and 10, a pressure energized seal apparatus 54 may be used which includes a seal member 56 (made, e.g. of rubber or of any suitable seal material) on top of which is a hard member 57 (e.g. made of metal, steel, hard plastic, composite, etc.). Fluid pressure on the hard member 57 pressurizes and thereby energizes the seal member 56. The snap ring 59 maintains the member 57 and the seal member 57 in place. optionally, as shown in FIG. 10A, a closure member such as a plug, seal, or valve member 60 may be located to seal against a seal seat 62 of the body 12 of the sub 10 so that two barriers are provided within the body 12. The member 60 can be inserted from above or through the side opening.

For continuous circulation of fluid down a wellbore WB (FIG. 1B, shown schematically), e.g. when it is desired to add a new piece or stand of pipe above the sub 10, the plug 21 is removed from the opening 13 and then (with the plug 21 moved out of the way and the closure apparatus 42 positioned as shown in FIG. 9) fluid is pumped from an active rig mud system ARS (FIG. 1A; shown schematically) into the housing 102 of the system 100 via a channel 11*a*, through the opening 13 and downhole in the wellbore WB, thus providing continuous circulation.

It is within the scope of the present invention, among other things, to use a system according to the present invention (e.g. like the system 100) in combination with a sub according to the present invention (e.g. like the sub 10) with a tong ("tong" including tongs and spinners), with tongs, or with an iron roughneck. In one aspect a system according to the present invention has an independent support and an independent movement apparatus for moving the system with respect to a tubular or a tubular string, and with respect to a tong, tongs, or an iron roughneck. In other aspects, a system according to the present invention is supported from the same support or frame that supports a tong, tongs, or an iron roughneck and an extension apparatus connected to the support or frame moves the system according to the present invention with the iron roughneck, or independently with respect thereto.

Figure 11A:
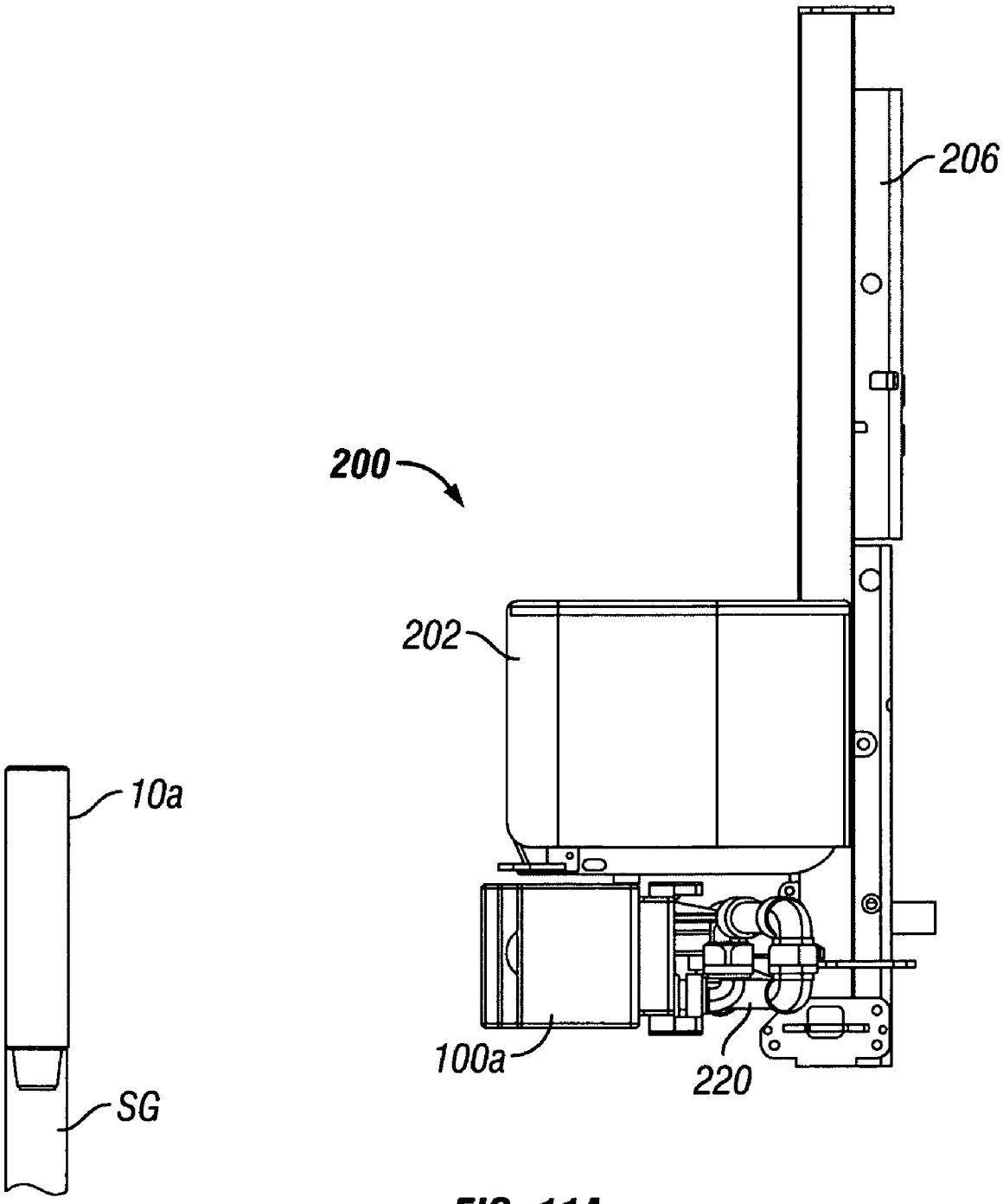
FIG. 11A is a side view illustrating a system according to the present invention.
Figure 11B:
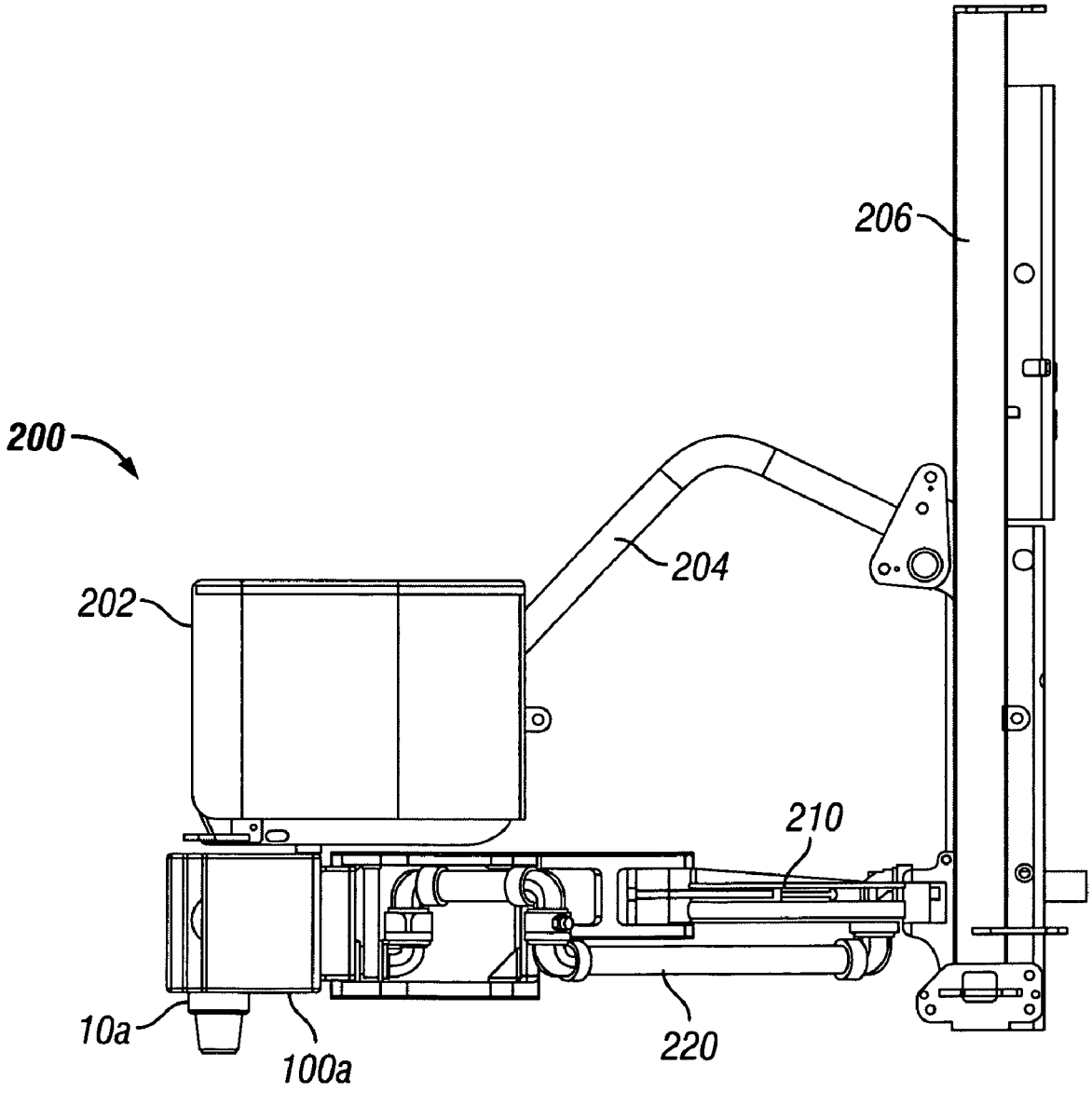
FIG. 11B is a side view showing the system of FIG. 11A extended.

A system 200 according to the present invention shown in FIGS. 11A and 11B has, shown schematically, a tubular manipulation apparatus 202 (which may be any such apparatus, including, but not limited to, a tong, tongs, a tong and a back-up tong, a tong and a spinning wrench or spinner, or an iron roughneck) which, in one particular aspect, is an iron roughneck (any suitable known iron roughneck system or apparatus) with an extension apparatus 204 (shown schematically, FIG. 11B) for extending and retracting the apparatus 202 with respect to a support frame 206.

A system 100*a* according to the present invention (like any system described herein according to the present invention including, but not limited to, the system 100) is connected to an extension apparatus 210 for extending and retracting the system 100*a* with respect to the frame 206. Conduit apparatus 220 is in communication with the system 100*a* and with an active rig mud system (e.g. like the system ARS, FIG. 1A).

A sub 10*a* (e.g. like the sub 10 described above) is used with the system 200. The sub 10*a* is connected to a string SG extending down into a wellbore.

Figure 11C:
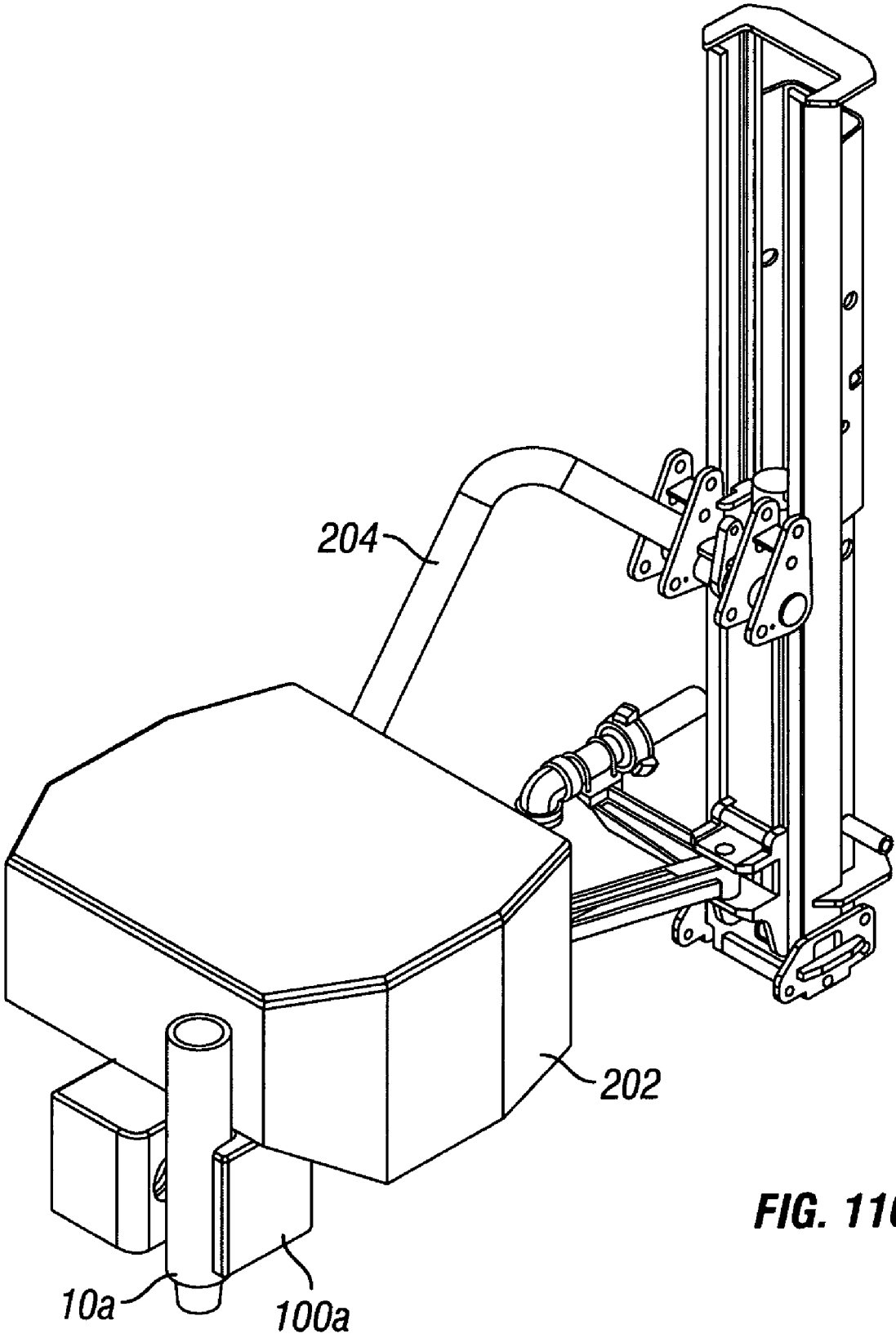
FIG. 11C is a perspective view of the system of FIG. 11B.
Figure 11D:
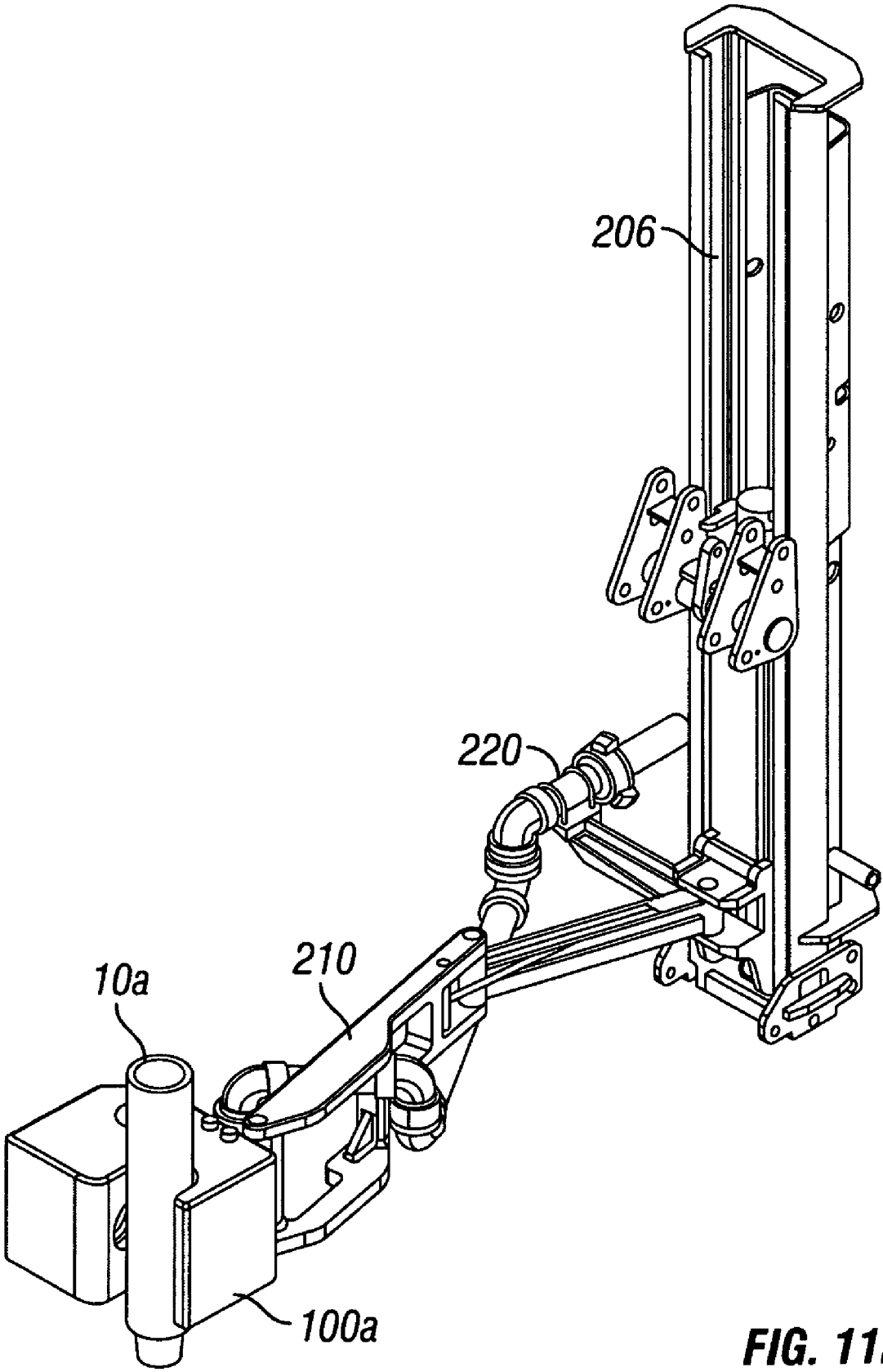
FIG. 11D is a perspective view of the system of FIG. 11B, with an iron roughneck removed.

As shown in FIGS. 11B and 11C, the iron roughneck 202 and the system 100*a* have been moved toward and then adjacent the sub 10*a*. The system 100*a* is operatively coupled to the iron roughneck 202 which is positioned to operate on a tubular above the sub 10*a*. The iron roughneck 202 can move with or independent of the system 100*a*.

FIGS. 12A-12D show various steps in the extension of a system 100*b* (like the system 100*a* or the system 100). An extension apparatus 230, connected to a support frame 228, has a back arm 232 pivotably connected at one end to the frame 228 and at the other end to a front arm 236. The front arm 236 is pivotably connected to the system 100*b*. A conduit apparatus 250 connects the system 100*b* to a mud system. The support frame 228, like the frame 206, can support the system 100*b* and an iron roughneck, or tong(s) and spinner(s). The system 100*b* may be moved by a separate movement system 100*c* (shown schematically, FIG. 12A) or it can be selectively connected to an iron roughneck and move as the iron roughneck moves. With a latch 238 engaged, described below, the arm 232 cannot move and the arm 236 can move.

A latch 238, held in a latch engaged position with a latch member 238*m* on the frame 228 by the force of a spring 234, prevents the back arm 232 from moving when the system is in a "parked" position. The latch 238 has one end pivotably connected to the back arm 232 and another end pivotably connected to a linakge member 240 which is connected to the arm 236. The spring 234 is in the linkage member 240. Until the arm 236 is moved, while the latch 238 is engaged, the arm 232 is prevented from moving and the spring 234 urges an end rod 240*a* toward the latch 238.

Figure 12A:
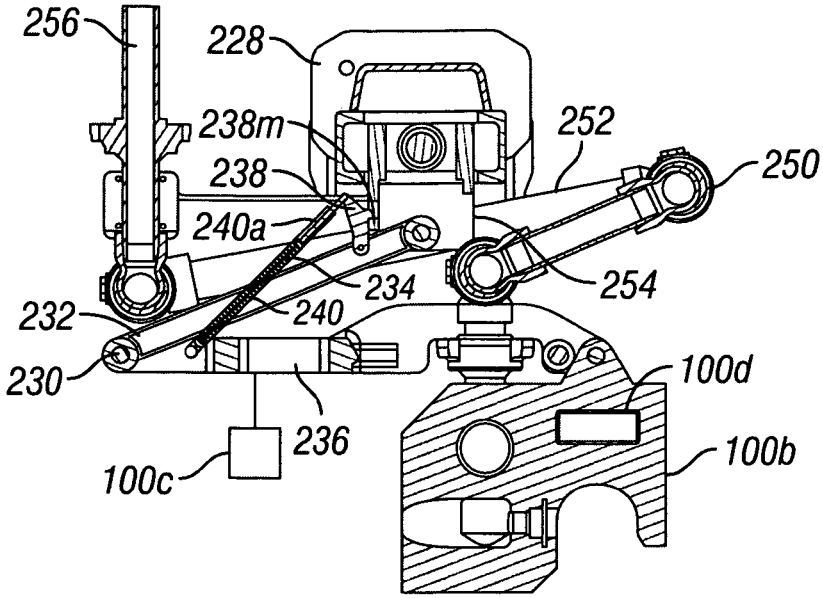
FIG. 12A is a top schematic view of a system according to the present invention in a non-extended "parked" position.
Figure 12B:
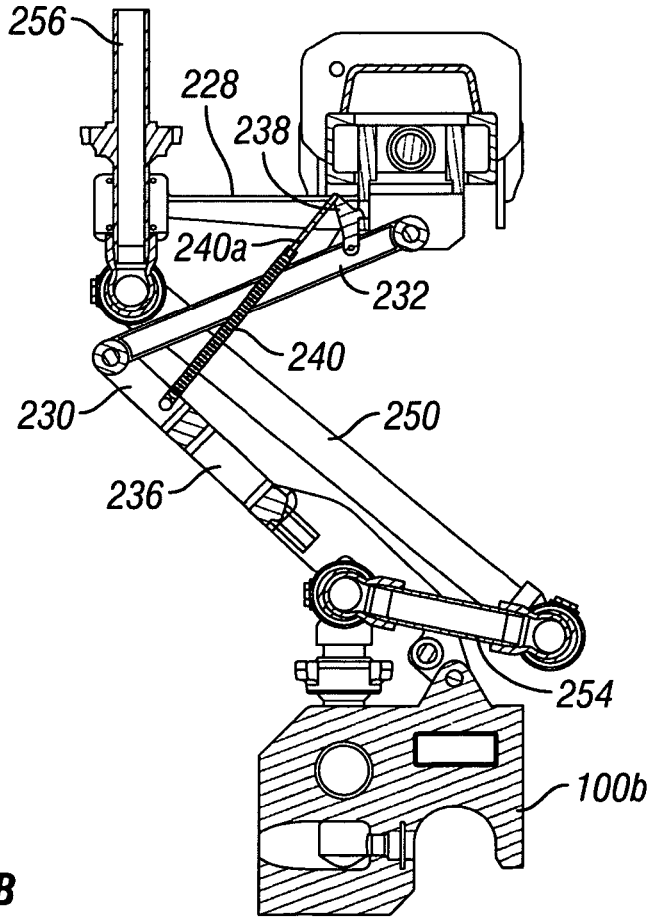
FIG. 12B is a top view showing a step in a method using the system of FIG. 12A.
Figure 12C:
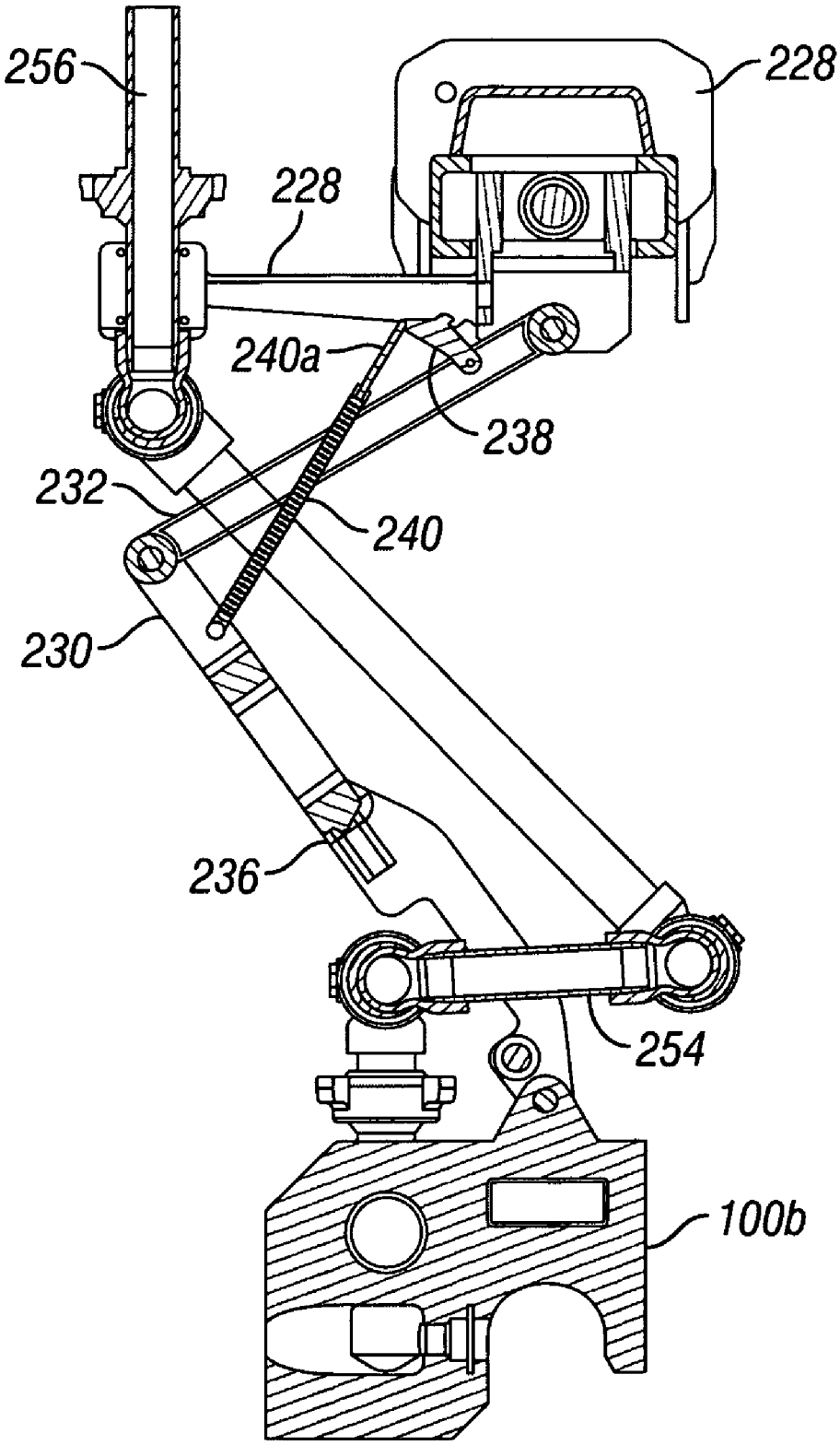
FIG. 12C is a top view showing a step in a method using the system of FIG. 12A.

As shown in FIG. 12C, the latch has been disengaged and the system 100*b* has begun its movement toward a well enter. Continued travel of the system 100*b* is shown in FIG. 12C.

Figure 12D:
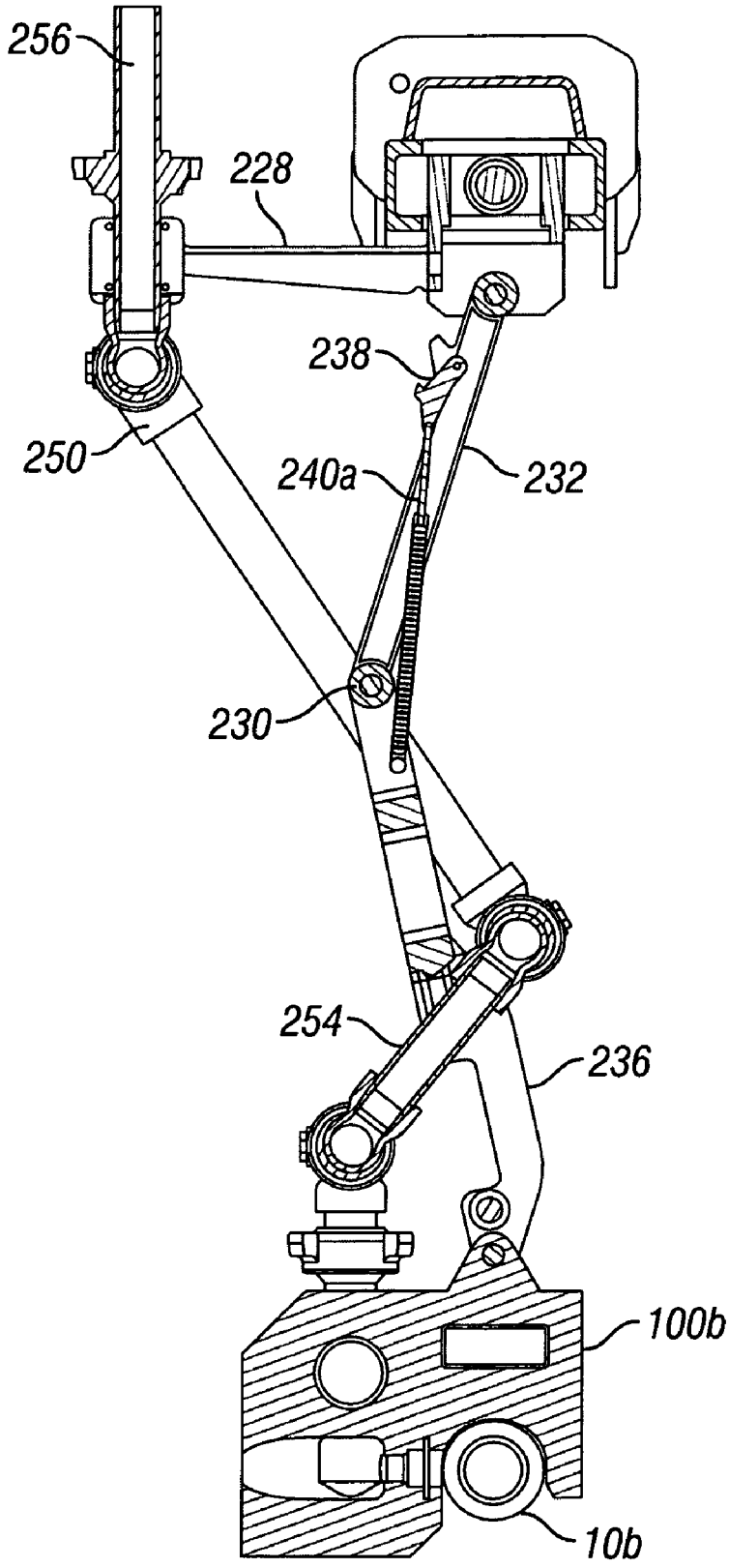
FIG. 12D is a top view showing a step in a method using the system of FIG. 12A.

FIG. 12D shows the extension apparatus 230 fully extended and the system 100*b* at well center engaged with a sub lob (like the sub 10*a*; like the sub 10).

Via a selective connection apparatus 100*d* shown schematically in FIG. 12A), the system 100*b* is selectively connected to an iron roughneck positioned above the system 100*b* (e.g., like the iron roughneck 202, FIG. 11A. Any suitable connection or connections can be used between the system 100*b* and the iron roughneck, e.g., but not limited to, a latch or latches; selectively projecting pins and/or pistons which project from one of the system 100*b* and the iron roughneck to corresponding holes and/or recesses in the other; magnetic apparatuses; a roller or rollers on one of the items and selectively move into corresponding slots on the other item; and/or releasably cooperating fastener material.

Figure 13A:
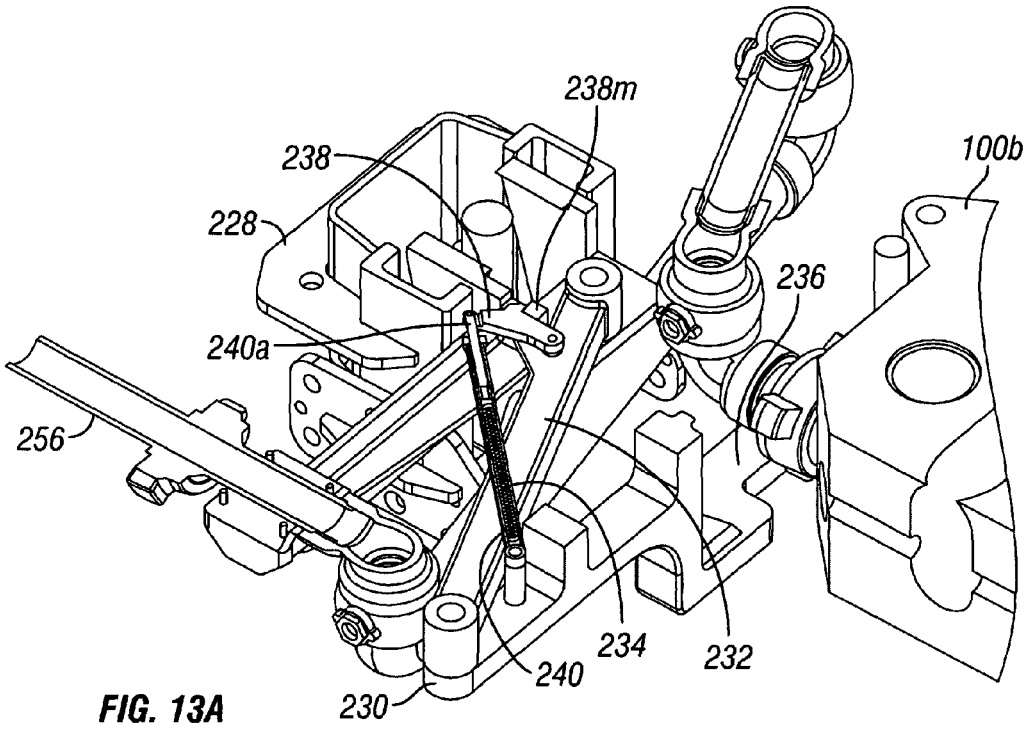
FIG. 13A is a perspective view of part of the system as shown in FIG. 12A.
Figure 13B:
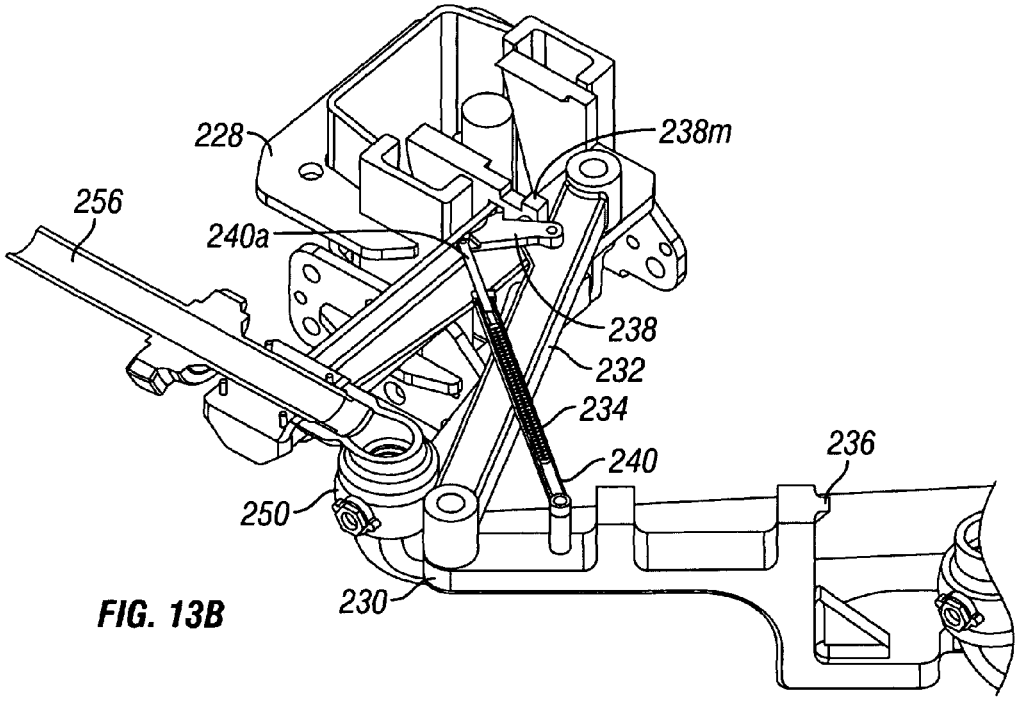
FIG. 13B is a perspective view of part of the system as shown in FIG. 12A.

FIGS. 13A and 13B illustrate operation of the latch 238. The spring 234 applies latching pressure to maintain the latch in a closed, engaged "parked" position (as in FIGS. 12A and 13B). As shown in FIG. 13A (and FIG. 12B), with the latch disengaged, the arm 232 can move.

The conduit apparatus 250 extends and retracts with the system 100*b*. The conduit apparatus 250 includes sealed, pivotably connected conduits 252, 254 and flow line 256 in fluid communication with a mud system.

The present invention, therefore, provides in some, but not in necessarily all, embodiments a system for continuous circulation wellbore operations, the system including a sub system having a sub positionable in fluid communication with a wellbore tubular string, the sub having: a body, the body being generally cylindrical and having a first end, a second end, and an exterior surface, the second end connectible to a wellbore tubular string; a bore through the body from the first end to the second end, the bore having an inner boundary defined by an inner surface of the body, the bore positionable for fluid communication with the wellbore tubular string; a side opening in the body, the side opening extending from the exterior surface of the body to the inner surface; and the sub system further including closure apparatus including a housing in fluid communication with the side opening of the body of the sub, the closure apparatus including a closure mechanism outside the body, the closure mechanism including a closure member within the housing and selectively insertable into the side opening and removable from the bore of the body, the closure member movable to selectively close off flow from the first end of the body. Such a system may one or some, in any possible combination, of the following: tubular manipulation apparatus adjacent the sub system; wherein the tubular manipulation apparatus is one of tong, tongs, tong and backup, tong and spinning wrench, and iron roughneck; wherein the sub system is selectively movable with the tubular manipulation apparatus; the sub further having a plug removably and sealingly secured in the side opening, the plug having a plug body, and a securement mechanism connected to the plug body for releasably securing the plug in the side opening; plug movement apparatus to which the plug is connected for moving the plug out of the side opening; the plug movement apparatus including stinger apparatus movable to connect with the plug and operate the securement mechanism to release the plug from the side opening; the sub further having two spaced-apart side opening recesses in communication with the side opening, and the securement mechanism including one or two dogs, the or each of the dogs selectively movable into and out of one of the two spaced-apart side opening recesses; wherein the inner surface of the body of the sub is curved and the plug has an outer curved surface, the outer surface of the plug substantially flush with the inner surface of the body; wherein the housing of the closure apparatus has an interior space and wherein fluid is flowable through the interior space of the housing into the bore of the body of the sub and out through the second end of the bore of the body so that continuous fluid circulation can be maintained in the wellbore tubular string; the closure apparatus including an extendable shaft, the extendable shaft extendable to position the closure member with respect to the bore of the body, the extendable shaft having a shaft channel therethrough, the closure member at an end of the extendable shaft, the closure member having a member channel therethrough, the member channel in fluid communication with the shaft channel so that with the closure member blocking fluid flow down to the second end of the sub fluid is flowable from the first end of the sub to and through the member channel of the closure member and then to and through the shaft channel; and/or wherein the fluid is drilling mud being pumped into the sub and flowing down through the first end of the body, and the shaft channel is in fluid communication with a rig mud system so that the drilling mud flowing out through the shaft channel flows to the rig mud system.

The present invention, therefore, provides in some, but not in necessarily all, embodiments a system for use in continuous circulation wellbore operations, the system including a sub system having a sub positionable in fluid communication with a wellbore tubular string, the sub having: a body, the body being generally cylindrical and having a first end, a second end, and an exterior surface, the second end connectible to a wellbore tubular string; a bore through the body from the first end to the second end, the bore having an inner boundary defined by an inner surface of the body, the bore positionable for fluid communication with the wellbore tubular string; a side opening in the body, the side opening extending from the exterior surface of the body to the inner surface; and the sub system further including closure apparatus including a housing in fluid communication with the side opening of the body of the sub, the closure apparatus including a closure mechanism outside the body, the closure mechanism including a closure member within the housing and selectively insertable into the side opening and removable from the bore of the body, the closure member movable to selectively close off flow from the first end of the body; plug apparatus having a plug body removably and sealingly secured in the side opening; a securement mechanism connected to the plug body for releasably securing the plug in the side opening; plug movement apparatus to which the plug is connected for moving the plug out of the side opening; the plug movement apparatus including stinger apparatus movable to connect with the plug and operate the securement mechanism to release the plug from the side opening; the housing of the closure apparatus having an interior space and wherein fluid is flowable through the interior space of the housing into the bore of the body of the sub and out through the second end of the bore of the body so that continuous fluid circulation can be maintained in the wellbore tubular string; the closure apparatus including an extendable shaft, the extendable shaft extendable to position the closure member with respect to the bore of the body, the extendable shaft having a shaft channel therethrough; the closure member at an end of the extendable shaft, the closure member having a member channel therethrough, the member channel in fluid communication with the shaft channel so that with the closure member blocking fluid flow down to the second end of the sub fluid is flowable from the first end of the sub to and through the member channel of the closure member and then to and through the shaft channel; wherein the fluid is drilling mud being pumped into the sub and flowing down through the first end of the body; the shaft channel is in fluid communication with a rig mud system so that the drilling mud flowing out through the shaft channel flows to the rig mud system; and tubular manipulation apparatus adjacent the sub system. In such a system, the tubular manipulation apparatus may be one of tong, tongs, tong and back-up, tong and spinning wrench, and iron roughneck.

The present invention, therefore, provides in some, but not in necessarily all, embodiments a system for continuous circulation wellbore operations, the system having: a sub system positionable in fluid communication with a wellbore tubular string; the sub system for selectively closing off flow to the wellbore tubular string; tubular manipulation apparatus adjacent the sub; and the tubular manipulation apparatus having one of tong, tongs, tong and back-up, tong and spinning wrench, and iron roughneck.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A system for continuous circulation wellbore operations, the system including a sub system having a sub positionable in fluid communication with a wellbore tubular string, the sub comprising a body, the body being generally cylindrical and having a first end, a second end, and an exterior surface, the second end connectible to a the wellbore tubular string, a bore through the body from the first end to the second end, the bore having an inner boundary defined by an inner surface of the body, the bore positionable for fluid communication with the wellbore tubular string, a side opening in the body, the side opening extending from the exterior surface of the body to the inner surface, and the sub system further including a closure apparatus including a housing in fluid communication with the side opening of the body of the sub, the closure apparatus including a closure mechanism outside the body, the closure mechanism including a closure member within the housing and selectively insertable into the side opening and removable from the bore of the body, the closure member movable to selectively close off flow from the first end of the body to the second end of the body, the closure apparatus including an extendable shaft having a shaft channel therethrough for diverting flow from the sub therethrough.

2. The system of claim 1 further comprising a tubular manipulation apparatus adjacent the sub system.

3. The system of claim 2 wherein the tubular manipulation apparatus is one of tong, tongs, tong and back-up, tong and spinning wrench, or iron roughneck.

4. The system of claim 2 wherein the sub system is selectively movable with the tubular manipulation apparatus.

5. The system of claim 1, the sub further comprising a plug removably and sealingly secured in the side opening, the plug comprising a plug body, and a securement mechanism connected to the plug body for releasably securing the plug in the side opening.

6. The system of claim 5 further comprising a plug movement apparatus to which the plug is connected for moving the plug out of the side opening.

7. The system of claim 6, wherein the plug movement apparatus further comprises a stinger apparatus movable to connect with the plug and operate the securement mechanism to release the plug from the side opening.

8. The system of claim 5, the sub further comprising two spaced-apart side opening recesses in communication with the side opening, and the securement mechanism including one or two dogs, each of the one or two dogs selectively movable into and out of one of the two spaced-apart side opening recesses.

9. The system of claim 5 wherein the inner surface of the body of the sub is curved and the plug has an outer curved surface, the outer surface of the plug substantially flush with the inner surface of the body.

10. The system of claim 1 wherein the housing of the closure apparatus has an interior space and wherein fluid is flowable through the interior space of the housing into the bore of the body of the sub and out through the second end of the bore of the body so that continuous fluid circulation can be maintained in the wellbore tubular string.

11. The system of claim 1 further comprising the extendable shaft extendable to position the closure member with respect to the bore of the body, the closure member at an end of the extendable shaft, the closure member having a member channel therethrough, the member channel in fluid communication with the shaft channel so that with the closure member blocking fluid flow down to the second end of the sub fluid is flowable from the first end of the sub to and through the member channel of the closure member and then to and through the shaft channel.

12. The system of claim 11 wherein the fluid is drilling mud being pumped into the sub and flowing down through the first end of the body, and the shaft channel is in fluid communication with a rig mud system so that the drilling mud flowing out through the shaft channel flows to the rig mud system.

13. A system for use in continuous circulation wellbore operations, the system including a sub system having a sub positionable in fluid communication with a wellbore tubular string, the sub comprising a body, the body being generally cylindrical and having a first end, a second end, and an exterior surface, the second end connectible to the wellbore tubular string, a bore through the body from the first end to the second end, the bore having an inner boundary defined by an inner surface of the body, the bore positionable for fluid communication with the wellbore tubular string, a side opening in the body, the side opening extending from the exterior surface of the body to the inner surface, and the sub system further including a closure apparatus including a housing in fluid communication with the side opening of the body of the sub, the closure apparatus including a closure mechanism outside the body, the closure mechanism-including a closure member within the housing and selectively insertable into the side opening and removable from the bore of the body, the closure member movable to selectively close off flow from the first end of the body to the second end of the body, a plug apparatus comprising a plug body removably and sealingly secured in the side opening, and a securement mechanism connected to the plug body for releasably securing the plug in the side opening, a plug movement apparatus to which the plug is connected for moving the plug out of the side opening, the plug movement apparatus including a stinger apparatus movable to connect with the plug and operate the securement mechanism to release the plug from the side opening, the housing of the closure apparatus having an interior space and wherein fluid is flowable through the interior space of the housing into the bore of the body of the sub and out through the second end of the bore of the body so that continuous fluid circulation can be maintained in the wellbore tubular string, the closure apparatus including an extendable shaft, the extendable shaft extendable to position the closure member with respect to the bore of the body, the extendable shaft having a shaft channel therethrough, the closure member at an end of the extendable shaft, the closure member having a member channel therethrough, the member channel in fluid communication with the shaft channel so that with the closure member blocking fluid flow down to the second end of the sub fluid is flowable from the first end of the sub to and through the member channel of the closure member and then to and through the shaft channel, wherein the fluid is drilling mud being pumped into the sub and flowing down through the first end of the body, the shaft channel is in fluid communication with a rig mud system so that the drilling mud flowing out through the shaft channel flows to the rig mud system, and a tubular manipulation apparatus adjacent the sub system.

14. The system of claim 13 wherein the tubular manipulation apparatus is one of tong, tongs, tong and back-up, tong and spinning wrench, or iron roughneck.

15. A method for continuously circulating fluid through a tubular string, the method comprising using a system for use in wellbore operations, the system including a sub system in fluid communication with a wellbore tubular string, the sub system having a sub comprising a body, the body being generally cylindrical and having a first end, a second end, and an exterior surface, a bore through the body from the first end to the second end, the bore having an inner boundary defined by an inner surface of the body, a side opening in the body, the side opening extending from the exterior surface of the body to the inner surface, and closure apparatus including a housing in fluid communication with the side opening and the closure apparatus including a closure mechanism outside the body, the closure mechanism including a closure member within the housing and selectively insertable into and removable from the bore of the body, the closure member movable to selectively close off fluid flow through the first end of the sub to the second end of the sub, the method including inserting the closure member into the bore of the body, closing off fluid flow from the first end of the sub to the second end of the sub with the closure member, and circulating fluid into the bore through the housing and out the second end of the sub into the wellbore tubular string.

16. The method of claim 15 wherein the sub further includes a plug initially removably and sealingly secured in the side opening, the plug comprising a plug body, and a securement mechanism connected to the plug body removably securing the plug in the side opening, the method further comprising prior to inserting the closure member into the bore, releasing the securement mechanism and removing the plug from the side opening so that the closure member may be inserted into the bore through the side opening.

17. The method of claim 16 wherein the sub system further includes a plug movement apparatus to which the plug is connected for moving the plug out of the side opening, the method further comprising moving the plug away from the side opening with the plug movement apparatus.

18. The method of claim 17 wherein the plug movement apparatus includes a stinger apparatus movable to connect with the plug and operate the securement mechanism to release the plug from the side opening, the method further comprising connecting the stinger apparatus to the plug, and operating the securement mechanism with the stinger apparatus.

19. The method of claim 16 wherein the sub system has two spaced-apart side opening recesses in communication with the side opening, and the securement mechanism includes one or two dogs, each of the one or two dogs selectively movable into and out of one of the two spaced-apart side opening recesses, the method further comprising holding the plug in the side opening with at least one dog in one of the spaced-apart side opening recesses.

20. The method of claim 16 wherein the inner surface of the body of the sub is curved and the plug has an outer curved surface, the method comprising positioning the outer surface of the plug substantially flush with the inner surface of the body.

21. The method of claim 15 wherein the housing of the closure apparatus has an interior space and wherein fluid is flowable through the interior space of the housing into the bore of the body of the sub and out through the second end of the bore of the body so that continuous fluid circulation can be maintained in the wellbore tubular string, the method further comprising flowing fluid through the interior space of the housing into the bore of the body of the sub and out through the second end of the bore of the body so that continuous fluid circulation is maintained in the wellbore tubular string.

22. The method of claim 15 wherein the closure apparatus includes an extendable shaft, the extendable shaft extendable to position the closure member with respect to the bore of the body, the extendable shaft having a shaft channel therethrough, the closure member at an end of the extendable shaft, the closure member having a member channel therethrough, the member channel in fluid communication with the shaft channel so that with the closure member blocking fluid flow down to the second end of the sub fluid is flowable from the first end of the sub to and through the member channel of the closure member and then to and through the shaft channel, the method further comprising with the closure member blocking fluid flow down to the second end of the sub, flowing fluid from the first end of the sub to and through the member channel of the closure member and then to and through the shaft channel.

23. The method of claim 22 wherein the fluid is drilling mud being pumped into the sub and flowing down into the first end of the body.

24. The method of claim 23 wherein the shaft channel is in fluid communication with a rig mud system so that the drilling mud flowing out through the shaft channel flows to the rig mud system.

25. The method of claim 15 wherein the system includes a tubular manipulation apparatus, the method further comprising connecting or disconnecting two tubulars with the tubular manipulation apparatus.

26. The method of claim 25 wherein the tubular manipulation apparatus is one of tong, tongs, tong and back-up, tong and spinning wrench, or iron roughneck.

27. The method of claim 25 wherein the system includes an iron roughneck, an iron roughneck extension system, and a sub system extension system, the method further comprising moving the iron roughneck with the iron roughneck extension system, and moving the sub system with the sub system extension system.

28. The method of claim 27 further comprising selectively moving the sub system with the iron roughneck.

29. The method of claim 27 further comprising initially latching the sub system extension system in a parked position and then unlatching the sub system extension system to move the sub system.

30. A system for continuous circulation wellbore operations, the system comprising a sub system positionable in fluid communication with a wellbore tubular string, the sub system having a closure mechanism including a shaft with a shaft channel therethrough selectively insertable into a sub of the sub system for selectively closing off flow to the wellbore tubular string and diverting flow through the shaft channel and out of the sub, and a tubular manipulation apparatus adjacent the sub.

* * * * *